US008266849B2

(12) United States Patent
Bravo et al.

(10) Patent No.: US 8,266,849 B2
(45) Date of Patent: Sep. 18, 2012

(54) INTERLOCKING PLATFORM PANELS AND MODULES

(75) Inventors: Victor Leonel Bravo, Barrie (CA); Lloyd Wilson Docter, Tacoma, WA (US)

(73) Assignee: McFarland Cascade Holdings, Inc., Tacoma, WA (US)

( * ) Notice: Subject to any disclaimer, the term of this patent is extended or adjusted under 35 U.S.C. 154(b) by 100 days.

(21) Appl. No.: 12/788,224

(22) Filed: May 26, 2010

(65) Prior Publication Data

US 2010/0300027 A1 Dec. 2, 2010

Related U.S. Application Data

(60) Provisional application No. 61/181,439, filed on May 27, 2009, provisional application No. 61/232,182, filed on Aug. 7, 2009.

(51) Int. Cl.
*E04F 11/16* (2006.01)

(52) U.S. Cl. ..... 52/177; 52/588.1; 52/589.1

(58) Field of Classification Search ..... 52/177, 52/263, 702, 302.1, 588.1, 589.1, 578, 579
See application file for complete search history.

(56) References Cited

U.S. PATENT DOCUMENTS

| | | | | |
|---|---|---|---|---|
| 2,377,211 A | * | 5/1945 | Cocken, Jr. | 404/40 |
| 3,056,476 A | * | 10/1962 | Fischer | 52/480 |
| 4,028,858 A | | 6/1977 | Rehbein | |
| 4,087,948 A | * | 5/1978 | Mellor | 52/180 |
| 4,170,859 A | | 10/1979 | Counihan | |
| 4,622,792 A | | 11/1986 | Betts | |
| 4,944,127 A | | 7/1990 | Clear | |
| 5,107,652 A | * | 4/1992 | Sosa | 52/578 |
| 5,361,554 A | | 11/1994 | Bryan | |
| 5,412,915 A | * | 5/1995 | Johnson | 52/177 |
| 5,441,786 A | | 8/1995 | Manassa | |
| 5,493,825 A | | 2/1996 | Gaston | |

(Continued)

FOREIGN PATENT DOCUMENTS

CA 2225988 C 7/2000

(Continued)

OTHER PUBLICATIONS

North Idaho Masonry & Hardscape Center, Inc., Web page entitled "Pave-EZE" describing a composite decking material, accessed at http://www.nimasonry.com/index_files/Page261.htm on May 19, 2010.

*Primary Examiner* — William Gilbert
*Assistant Examiner* — Gisele Ford
(74) *Attorney, Agent, or Firm* — Eric W. Cernyar

(57) ABSTRACT

A platform panel or module is provided to construct a surface for a deck, floor, wall, ceiling, or roof. The panel or module comprises a decorative top layer integral with or joined to a structural, composite molded platform. Each platform panel or module has two complementary module-coupling sides that take advantage of the full width of each joist that supports the platform. Also, male and female connecting members are disposed along the module-coupling sides that enable one platform panel or module to be efficiently and positively interlocked with an adjacent panel or module. Each panel or module can be fastened on one side to a single joist while being secured on its opposite side to an adjoining panel or module. The panels or modules are also designed to cover over an entire joist substructure, including the beginning-of-sequence and end-of-sequence joists.

16 Claims, 32 Drawing Sheets

U.S. PATENT DOCUMENTS

| | | | | |
|---|---|---|---|---|
| 5,497,593 | A * | 3/1996 | Riesberg | 52/702 |
| 5,511,353 | A | 4/1996 | Jones | |
| 5,758,467 | A | 6/1998 | Snear et al. | |
| 5,906,084 | A | 5/1999 | Millington et al. | |
| 6,098,362 | A | 8/2000 | Marriott et al. | |
| 6,128,880 | A | 10/2000 | Meenan, Jr. | |
| 6,209,267 | B1 | 4/2001 | Dantzer | |
| 6,247,286 | B1 * | 6/2001 | Heyns | 52/589.1 |
| 6,311,443 | B1 | 11/2001 | Allazetta | |
| 6,374,555 | B1 | 4/2002 | Gusler | |
| 6,467,224 | B1 | 10/2002 | Bertolini | |
| 6,558,766 | B2 | 5/2003 | Padmanabhan et al. | |
| 6,578,334 | B2 * | 6/2003 | Watanabe | 52/314 |
| 6,601,360 | B2 | 8/2003 | Spiers | |
| 6,651,398 | B2 | 11/2003 | Gregori | |
| 6,802,159 | B1 * | 10/2004 | Kotler | 52/177 |
| 6,804,923 | B1 | 10/2004 | Potter | |
| 6,941,715 | B2 * | 9/2005 | Potter | 52/480 |
| D532,530 | S * | 11/2006 | Shuman et al. | D25/163 |
| 7,365,120 | B2 | 4/2008 | Haraguchi et al. | |
| 7,698,859 | B2 * | 4/2010 | Marti | 52/177 |
| 2003/0097808 | A1 * | 5/2003 | Sabatini | 52/384 |
| 2004/0226242 | A1 * | 11/2004 | Moller, Jr. | 52/384 |
| 2005/0257483 | A1 | 11/2005 | Wilhelmsson | |
| 2005/0284082 | A1 | 12/2005 | Smith | |
| 2007/0094979 | A1 * | 5/2007 | Richardson et al. | 52/578 |
| 2008/0072514 | A1 | 3/2008 | Barlow | |
| 2008/0118703 | A1 * | 5/2008 | Marti | 52/177 |
| 2008/0127593 | A1 * | 6/2008 | Janesky | 52/581 |

FOREIGN PATENT DOCUMENTS

| | | | |
|---|---|---|---|
| DE | 19952469 | A1 | 5/2001 |
| WO | WO2004015202 | A1 | 2/2004 |
| WO | WO2008/040039 | A1 | 4/2008 |

* cited by examiner

INTERLOCKING PLATFORM PANELS AND MODULES

RELATED APPLICATIONS

This application claims the benefit of, and hereby incorporates by reference, our earlier U.S. provisional patent application Nos. 61/181,439, filed May 27, 2009 and entitled "Interlocking Platform Surfacing System," and 61/232,182, filed Aug. 7, 2009, entitled "System of Modular Surface Platform Panels."

FIELD OF THE INVENTION

This invention relates generally to deck, floor, ceiling, wall, and roof surfaces, and in particular, to modular surface platforms and panels mounted on an underlying substructure to form the surface of a deck, floor, wall, ceiling, or roof.

BACKGROUND OF THE INVENTION

The prior art discloses numerous systems for creating the surface of a deck, floor, ceiling, wall, or roof. A significant category of this prior art utilizes pre-assembled or modular panels or sections to form the desired surface.

Many references disclose modular flooring systems intended for installation on a flat subfloor. U.S. Pat. No. 4,170,859 to Counihan discloses pre-assembled sections of elongated boards that have a special joint for interlocking them with other identically-fashioned sections. Each pre-assembled section has a groove that receives the tongue of a separate, customized channel strip for joining the sections together. U.S. Pat. No. 5,511,353 to Jones discloses a portable decking system formed from a plurality of flat panels designed to be placed directly on the ground and joined together by separate W-shaped clips. U.S. Pat. No. 6,311,443 to Allazetta discloses a pre-manufactured deck panel designed for installation on a solid foundation. These systems are all designed for direct installation on top of a subfloor, not for installation over a conventional joist substructure.

Other references require the construction of highly specialized custom joist or pedestal substructures. Both U.S. Pat. No. 4,622,792 to Betts and U.S. Pat. No. 5,361,554 to Bryan disclose modular deck structures comprising a plurality of pallet-like flooring sections that are seated on rabbitted ledges or planks recessed within the square frames of a specially-constructed, intersecting joist structure. U.S. Pat. No. 6,209,267 to Dantzer discloses modular floor panels that are installed on specially constructed square frames that are in turn mounted on posts. None of these flooring systems are designed for installation over a conventional joist substructure.

Yet other references require substantial modifications or additions to conventional joist substructures. Conventional wood joists used for joist substructures usually have a width of approximately 38 mm (1.5 inches). If the square-shaped modular platform panels taught in many of these references installed without the addition of a joist plate or holding bracket, the joists would only support each panel along thin, approximately 19 mm (¾-inch) wide strips.

Accordingly, many prior art references require the preliminary installation of a joist plate or holding bracket. For example, U.S. Pat. No. 6,941,715 to Potter discloses a modular panel deck system. But the modular panels require, for their support, a plurality of elongated, 51 mm (2 inch) wide joist plates that must first be fastened to the underlying deck joists. The joist plates have flanges for supporting the modular panels. The modular deck panels are also joined by plurality of elongated spline elements that are mounted perpendicular to the elongated joist plates. U.S. Pat. No. 6,128,880 to Meenan, Jr., also discloses a system of modular deck panels. But, like Potter, Meenan requires the preliminary installation of joist caps to support the deck panels. U.S. Pat. No. 6,098,362 to Marriott et al. discloses an interlocking flooring tile. But Marriott et al. requires the preliminary installation of large U-shaped troughs, on which the downwardly projecting legs of the tiles rest. U.S. Pat. No. 5,758,467 to Snear discloses modular deck members with integral groove portions to interconnect with other deck members along the same, longitudinal dimension as the parallel joists to which the members are affixed. But to join the deck members along the lateral dimension, Snear requires a T-rail be installed between them.

The state of the art would be advanced by a system of modular interlocking platforms that could be mounted directly on, and be fully supported by, a conventional joist substructure without the additional support of joist plates or holding brackets. The state of the art would also be advanced by a modular deck system in which each panel or panel-supporting platform could be mounted to the joist substructure with a minimal number of threaded fasteners. The state of the art would also be advanced by designing a uniformly configured platform panel piece that can be trimmed in pieces and still readily attached to the joist substructure and also support a top decorative layer that is completely flush with the outer edges of the beginning-of-sequence and end-of-sequence joists. The state of the art would also be advanced by new methods for attaching a decorative top layer to a modular decking platform.

SUMMARY OF THE INVENTION

The invention provides a platform structure for a deck, floor, wall, ceiling, or roof surface. The platform structure comprises a plurality of prefabricated interlocking platform panels or modules, especially configured for use on a joist substructure, but also suitable for installation over structural pedestals and flat subfloors. The platform panels or modules may be construed to either include, or to merely be adapted to support, a surface layer comprising the deck, floor, wall, ceiling, or roof surface of a structure. Furthermore, the included or supported surface layer may be a decorative layer, such as real or faux stone, ceramic, tile, rubber, plastic, or wood. The platform panels or modules interlock with each other, providing a modular deck, floor, wall, ceiling, or roof surface.

Each platform panel or module includes an interlocking structural platform or sublayer that is installed over a substructure. The structural platform or sublayer preferably comprises a single piece injection molded part made of polymeric resin and reinforcing materials. The structural platform or sublayer provides a structural base for a surface to be installed over a joist, pedestal, or other substructure of a deck, floor, wall, roof, or ceiling.

Each platform panel or module is attached to the underlying substructure with a minimum number of conventional screws. Each platform panel or module is adapted to interlock with a plurality of identically-configured platform panels or modules upon the substructure.

The decorative top layer is secured, via adhesive, molded attachment, or other means, to the structural platform or sublayer, concealing all of its fasteners and substantially all of the sublayer—except for a portion that is designed to be inserted under the shelf of an adjoining panel.

Each platform panel or module has opposite complementary panel- or module-coupling sides. One of the panel- or module-coupling sides extends inwardly, along a nonlinear profile, from one side of the top layer, underneath the top layer. The opposite panel- or module-coupling side protrudes outwardly, along a complementary nonlinear profile, from beneath the opposite edge of the top layer. Each panel- or module-coupling side makes full use of the standard 38 mm (1.5 inch) width of each joist over which the panel's or module's ends are mounted.

The composition of the platform panel or module and its placement of panel- or module-coupling clips and vertical and horizontal fasteners makes it easy to trim the platform panel or module into virtually any shape and still attach it to the substructure.

Each platform panel or module also incorporates a plurality of additional molded, pultruded, stamped, or riveted features. For example, each platform panel or module includes a lattice structure of reinforcing ribs that increase the structural strength of the platform panel or module while minimizing its overall weight. Each platform panel or module also includes male connectors (such as clips or tabs) that engage corresponding female receptacles of an adjacent platform panel or module. Also, small 3 mm (⅛ inch) ribs on the sides of the panel or module establish an exact and consistent spacing between adjacent panels or modules to allow for water drainage and air circulation.

Each platform panel or module is designed for easy installation. In one embodiment, one panel is installed adjacent to and into interlocking engagement with another by tilting it and then dropping it to a level position. Only the opposite, not-yet-coupled side need be fastened to one of the two joists the panel spans. The panel is held to the opposing joist—on the side to which it is coupled to the previously mounted adjoining panel—by its interlocking relationship with that adjoining panel.

Large horizontal tabs on one side of each platform panel include two holes or indentations for screws, nails, or other fasteners that positively attach the panel to the joist substructure and restrict movement in the vertical and horizontal directions. Diagonal holes or indentations incorporated in various locations, including the panel- or module-coupling and joist-spanning sides, provide additional fastening capability.

It is believed that there are several inventive and potentially patentably distinct aspects to the invention, each having patentable merit in its own right. Among these is the elimination of the preliminary step of installing a joist plate prior to the installation of the platform panel or module. Another aspect is the use of nonlinear complementary profiles along opposing panel- or module-coupling sides of the panel or module that take advantage of the full width of the joist to support the platform. Yet another aspect is the manner in which the preferred embodiment can be sold as a single identically-configured unit adequate to fully cover the joist substructure while presenting a decorative top layer that is fully flush with the outside edges of the beginning-of-sequence and end-of-sequence joists. Yet another aspect is the efficient manner in which the preferred embodiment can be assembled with, or disassembled from, adjoining panels and the minimal number of vertical fasteners (such as nails or screws) required to adequately secure the panels to the joists. Yet another aspect is the manner in which the panels or modules interlock with, or are separated from, each other. Yet another is the inclusion of interlocking features preferably only on the panel- or module-coupling sides, and not the joist-spanning sides, of the panels or modules.

Other distinguishing features include the ability to manufacture the panels or modules through injection molding; the trimmability of each panel or module into numerous still-mountable shapes; the combination of a reinforced structural platform with a decorative top layer that conceals any underlying screws; and the ways in which the top decorative layer is secured to the structural platform. For example, in one embodiment, adhesive penetrates and mushrooms through small apertures in the platform to generate a mechanical, as well as adhesive, bond between the decorative top layer and the platform. In another embodiment, the panel or module is manufactured by a process that includes placing the decorative top layer into a mold and placing resin for the structural substrate or platform into the mold, in a manner that attaches the decorative top layer to the structural substrate or platform.

It should be understood that the invention may extend to any combination or singular one of the aforementioned features, or of other features not summarized herein.

DETAILED DESCRIPTION OF THE INVENTION

Figure 1:
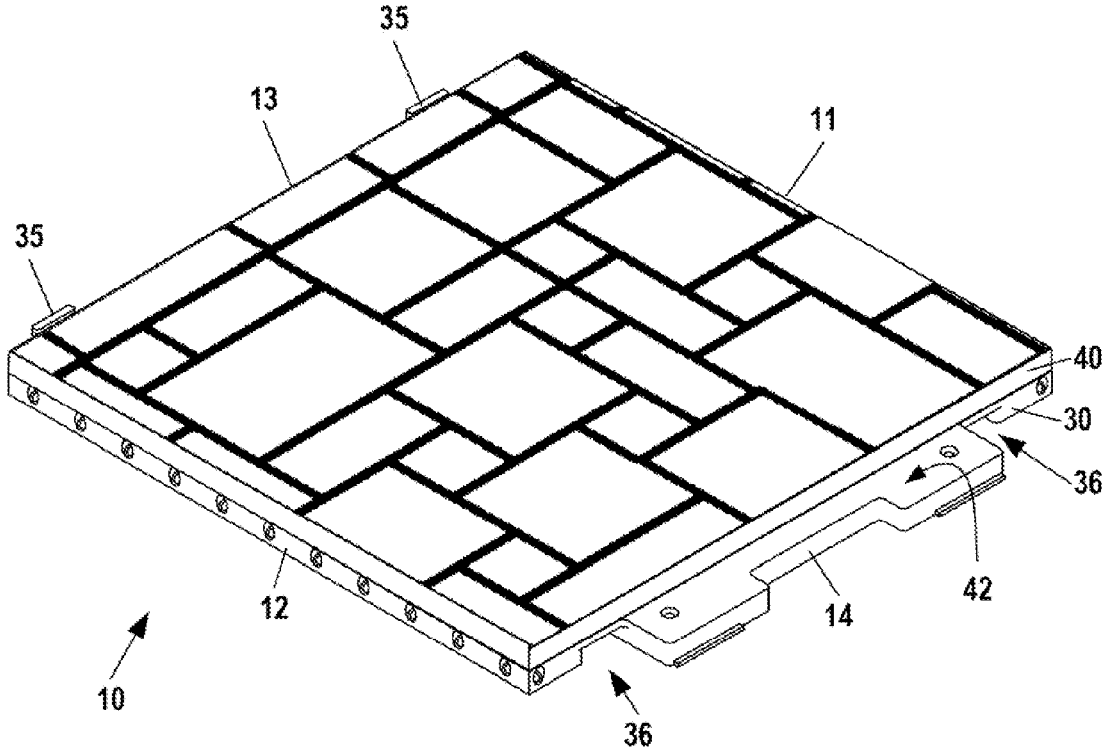
FIG. 1 is a top perspective view of one embodiment of a prefabricated interlocking platform panel or module, including a decorative veneer, according to the present invention.
Figure 82:
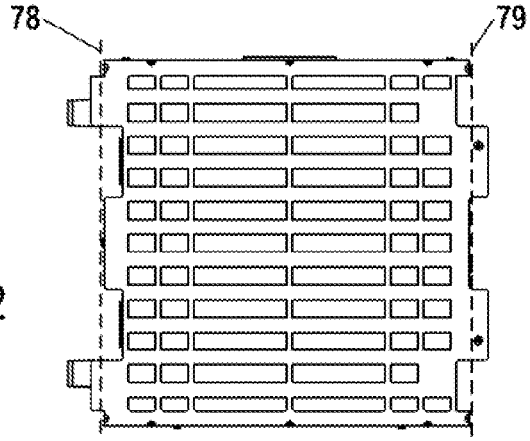
FIG. 82 is a top plan view of the platform module of FIG. 54, with dashed lines showing cut lines for beginning-of-joist and end-of-joist installations.

In describing preferred and alternate embodiments of the technology described herein, as illustrated in FIGS. 1-82, specific terminology is employed for the sake of clarity. The technology described herein, however, is not intended to be limited to the specific terminology used, and it is to be understood that each specific element includes all technical equivalents that operate in a similar manner to accomplish similar functions.

FIGS. 1-82 illustrate various embodiments of a surface platform panel or module 10 according to the present invention. Most of these drawings illustrate surface platform panels or modules 10 with general dimensions of approximately 406 mm (16 inches) by 445 mm (17.5 inches) by 15 mm (0.6 inches), which are particularly suitable for 16-inch (406 mm) off-center joist substructures 90. The invention, however, encompasses platform panels or modules 10 with other dimensions, shapes, and configurations.

Figure 36:
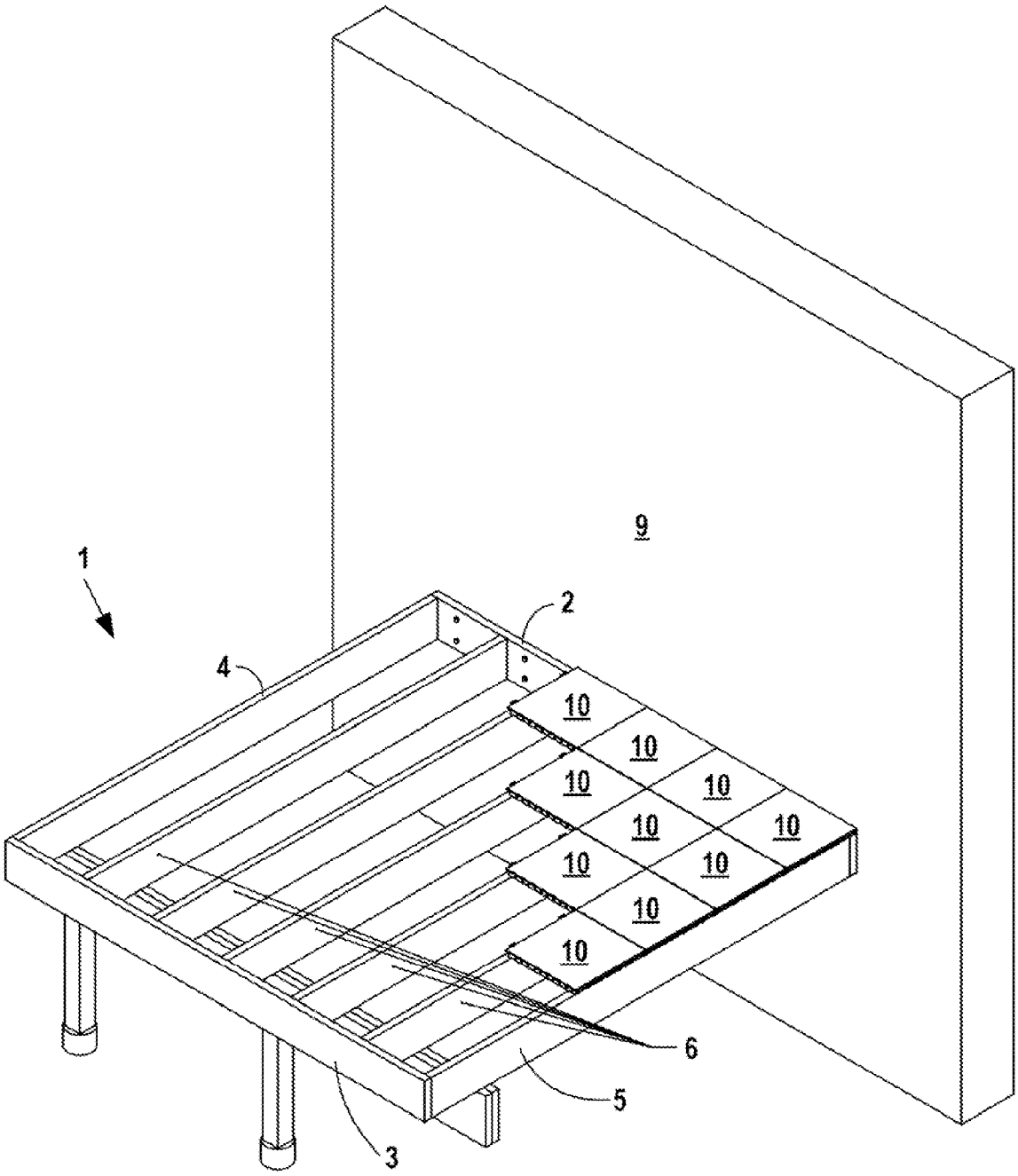
FIG. 36 is a perspective view of a typical deck structure.

The platform panel or module 10 is particularly configured for installation on joist substructures. It is also suitable for installation on corner pedestal substructures and other foundations and surfaces. Because the invention is particularly suited to—albeit not limited to—installation on typical joist substructures, FIG. 36 illustrates a typical deck joist substructure 1. The joist substructure 1 comprises a ledger joist 2 that is connected to a wall 9, a header rim joist 3 opposite the ledger joist 2, two side rim joists 4 and 5, and a plurality of span joists 6 in between and parallel to the side rim joists 4 and 5. FIGS. 37-40 illustrate portions of similar joist substructures 1, and FIGS. 44-48 and 78-82 illustrate some alternative joist substructures. The figures also illustrate a plurality of platform panels or modules 10 installed on the joist substructures.

Each platform panel or module 10 comprises a structural platform or substrate 30 that is either integral with, joined to, or configured to support a decorative top layer, surface or veneer element 40. As used in the claims, a "panel" or "module" may either consist substantially only of this structural platform 30 (as illustrated in most of the drawings) or comprise the combination of this structural platform 30 with the decorative top layer 40 (e.g., FIGS. 1, 40). Also, by referring to the platform 30 as "structural," it means that the platform or substrate 30 is relatively rigid, load-bearing, provides a means for connecting adjoining platform panels or modules 10 together, and/or provides a means of attaching the panel or module 10 to a joist substructure, corner pedestal system, or other foundation. To be "structural," the structural platform 30 does not have to be strong enough to bear normally expected loads by itself. In embodiments that include stone top surfaces 40, for example, the stone layer or surface 40 may contribute to some, or even most, of the panel or module 10's load-bearing capacity. In embodiments in which the platform panels or modules 10 are installed over a flat foundation or surface, the platform panel or module 10 itself need not have much load-bearing capacity because the loads are transferred to the underlying foundation or surface. In some embodiments, the structural platform 30 will be high-strength and reinforced.

Figure 2:
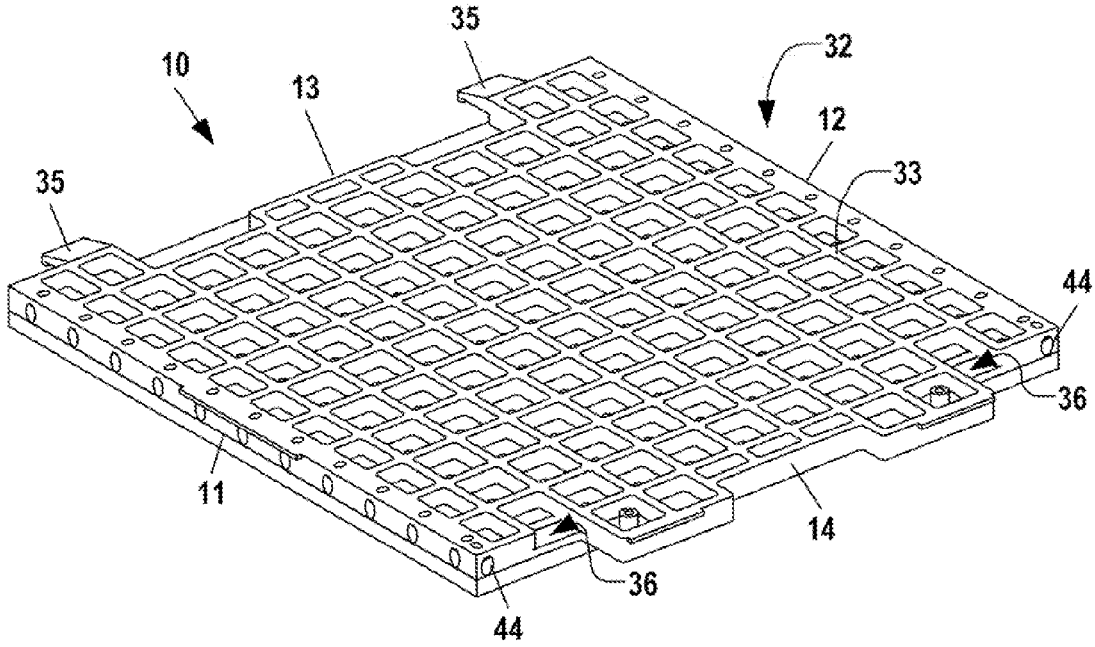
FIGS. 2 and 3 are bottom perspective views of the platform panel or module of FIG. 1.
Figure 4:
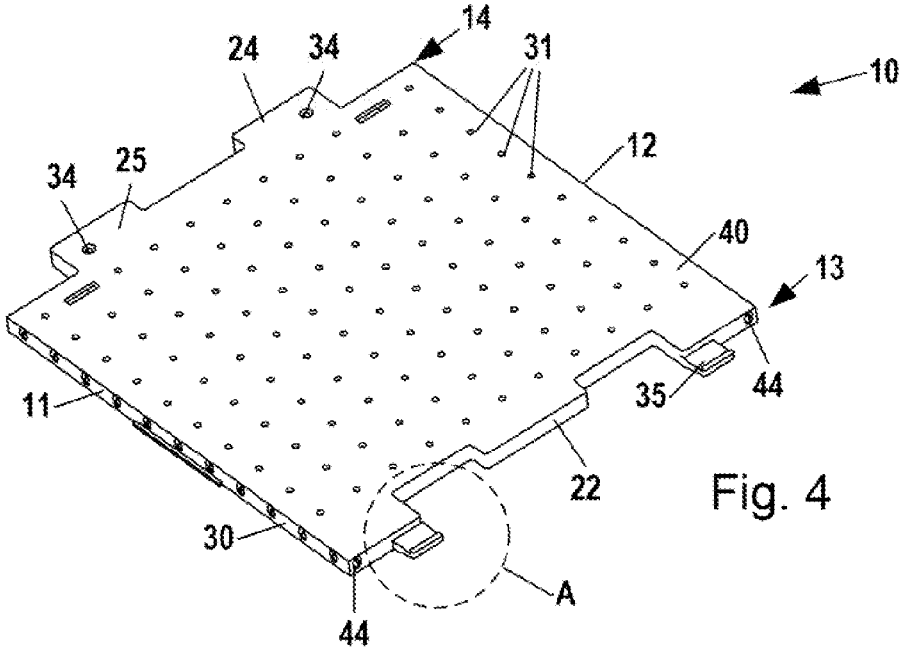
FIGS. 4 and 5 are top perspective views of one embodiment of a platform module, without a decorative veneer, and with male and female connecting members.
Figure 23:
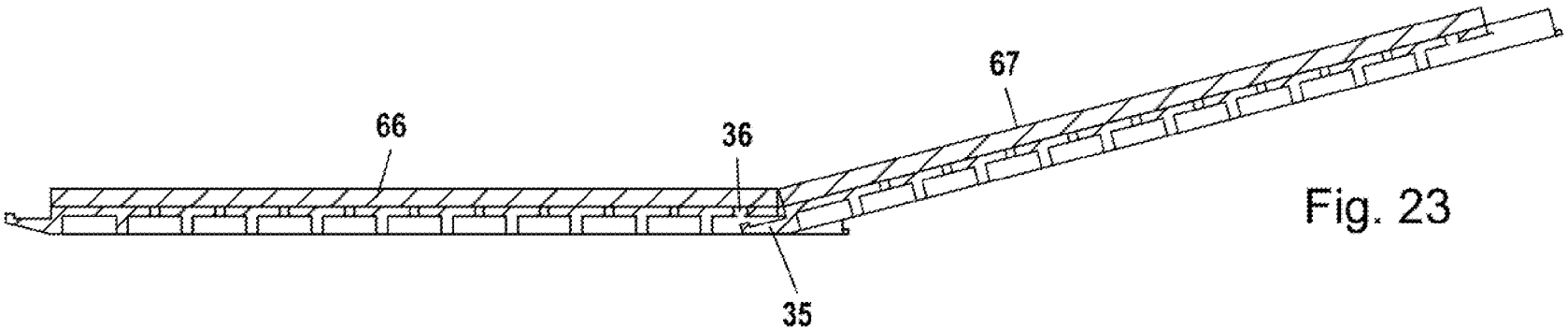
FIGS. 23 and 24 are partial cross-sectional views taken along line G-G in FIG. 22, illustrating a process for interlocking one platform panel or module with another.
Figure 24:
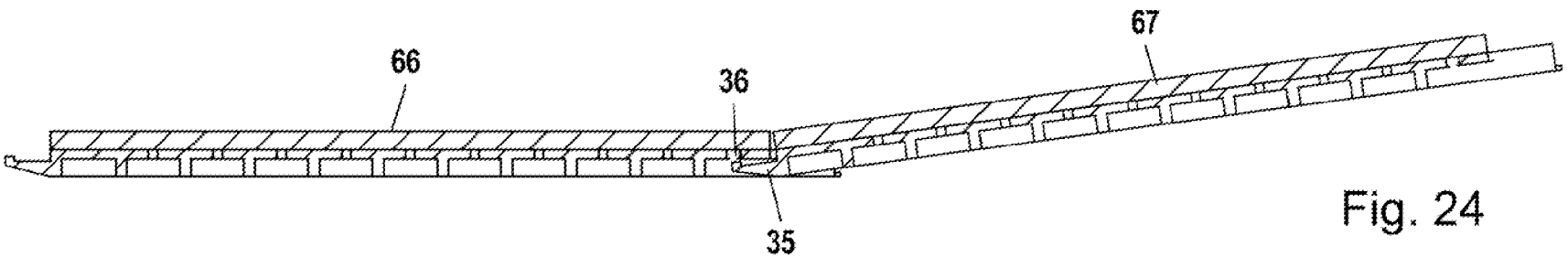
Figure 25:
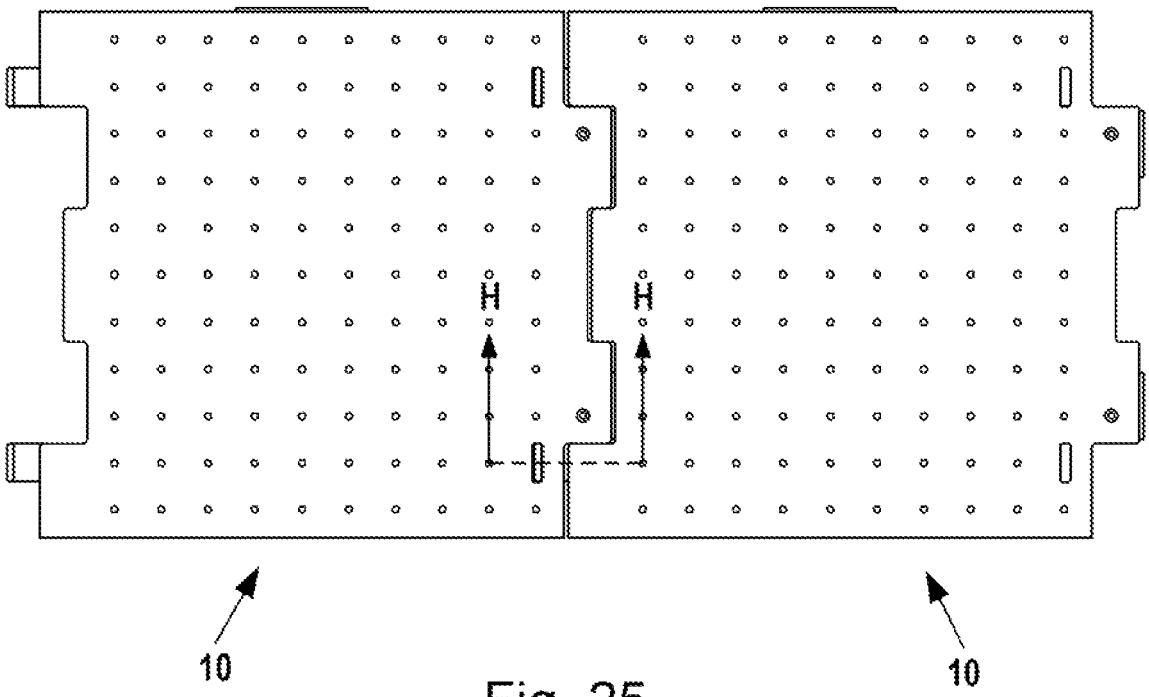
FIG. 25 is a top plan view of the interlocked pair of platform panels or modules shown in FIG. 21.
Figure 56:
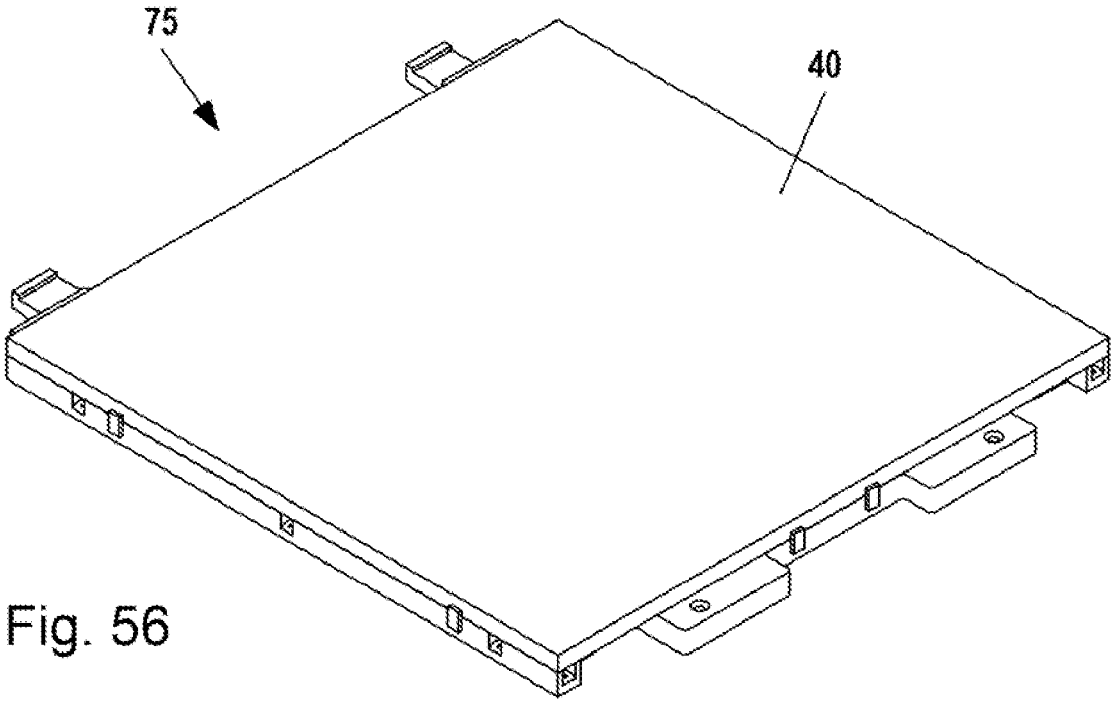
FIG. 56 is a perspective top view of the platform module of FIG. 54 with a top layer.
Figure 57:
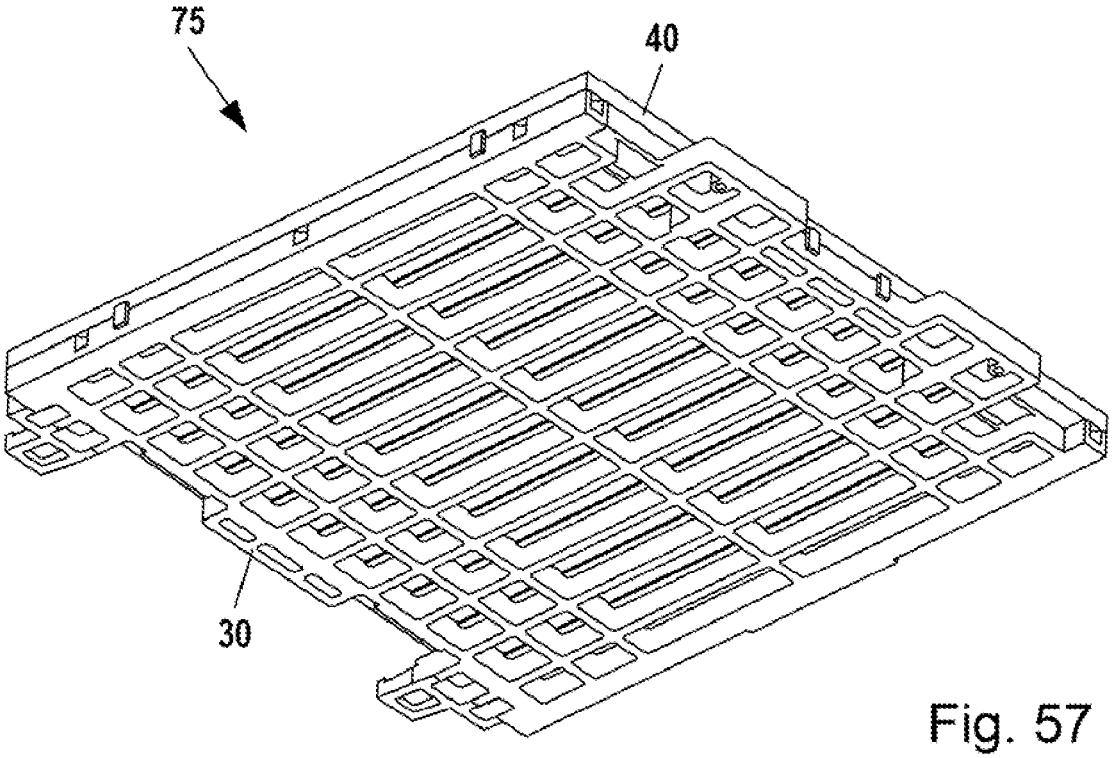
FIG. 57 is a perspective bottom view of the platform module of FIG. 56.
Figure 58:
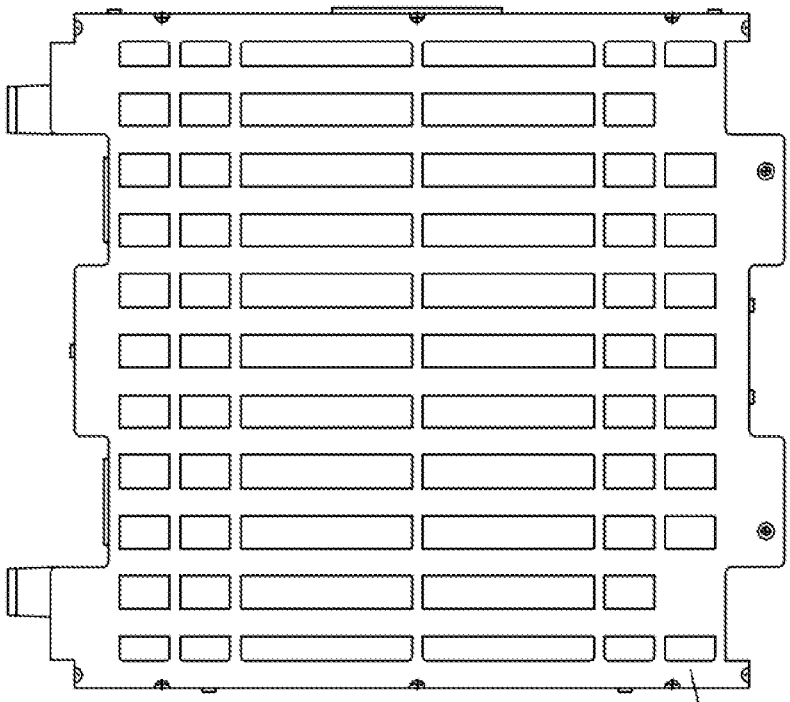
FIG. 58 is a top plan view of the platform module of FIG. 54.
Figure 59:
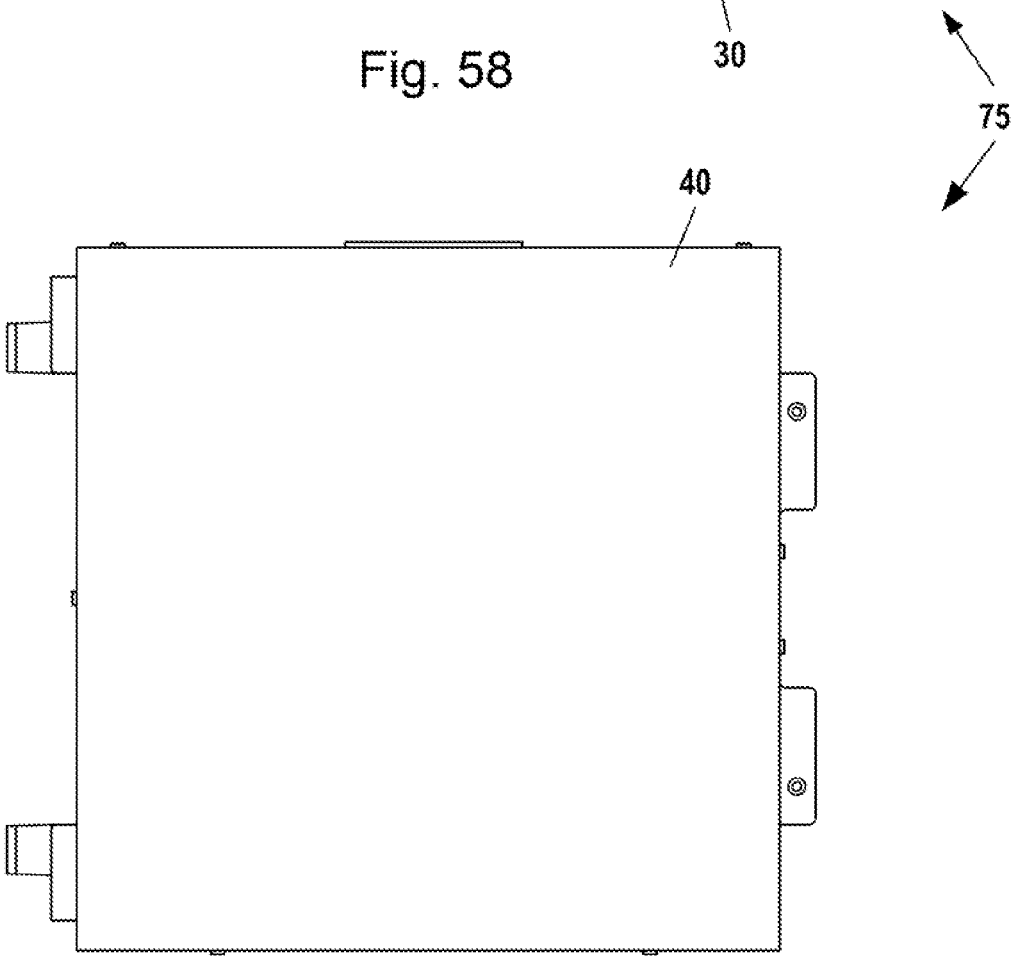
FIG. 59 is a top plan view of the platform module of FIG. 54, with a decorative layer included.
Figure 60:
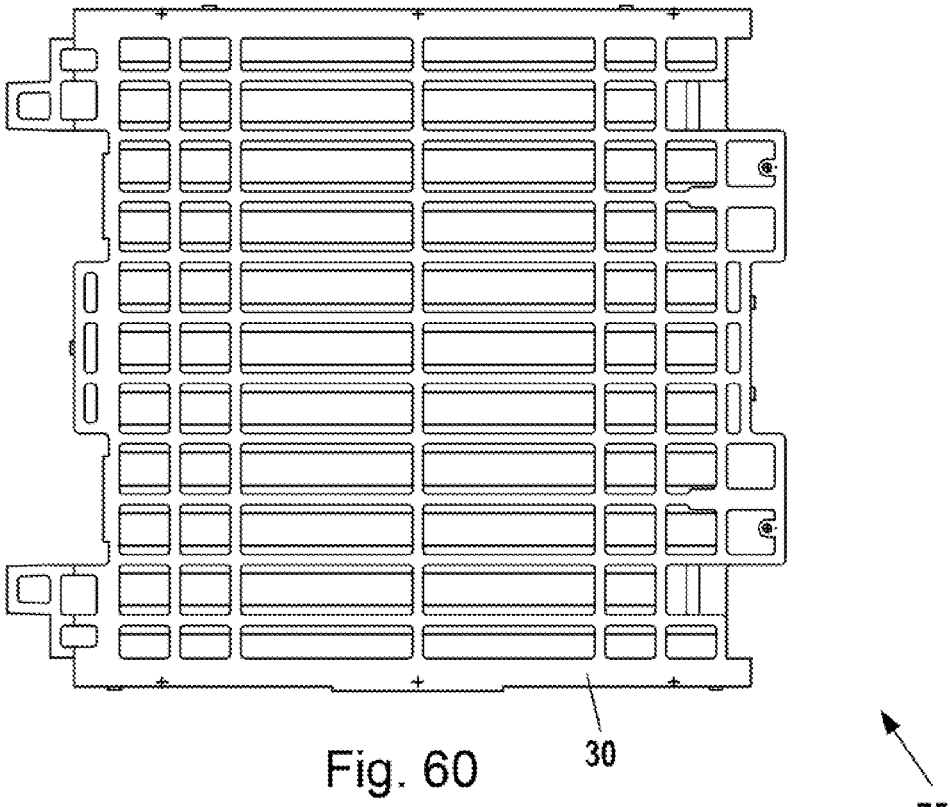
FIG. 60 is a bottom plan view of the platform module of FIG. 54.
Figure 61:
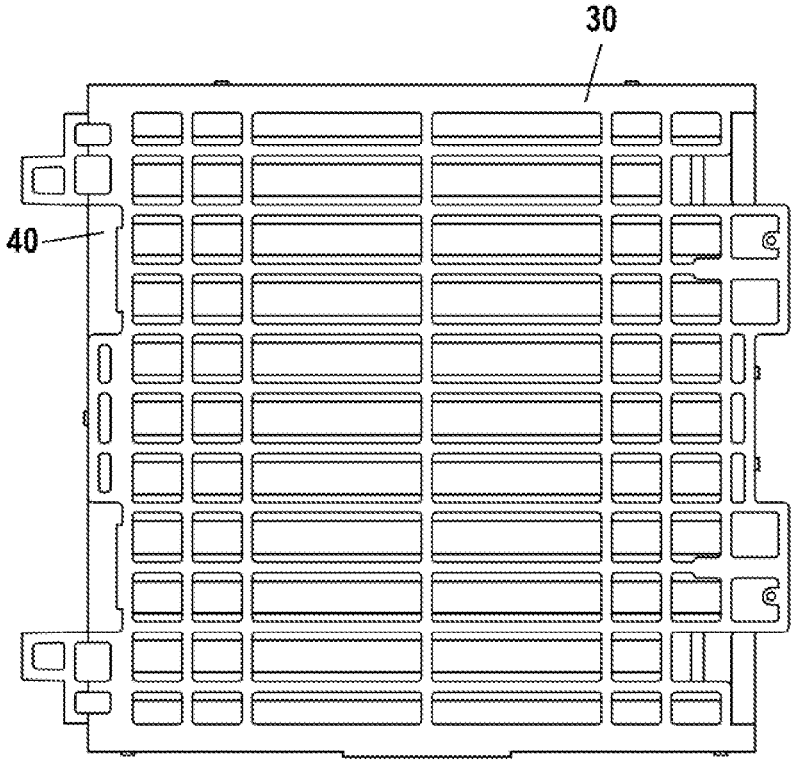
FIG. 61 is a bottom plan view of the platform module of FIG. 54, with a decorative layer included.
Figure 62:
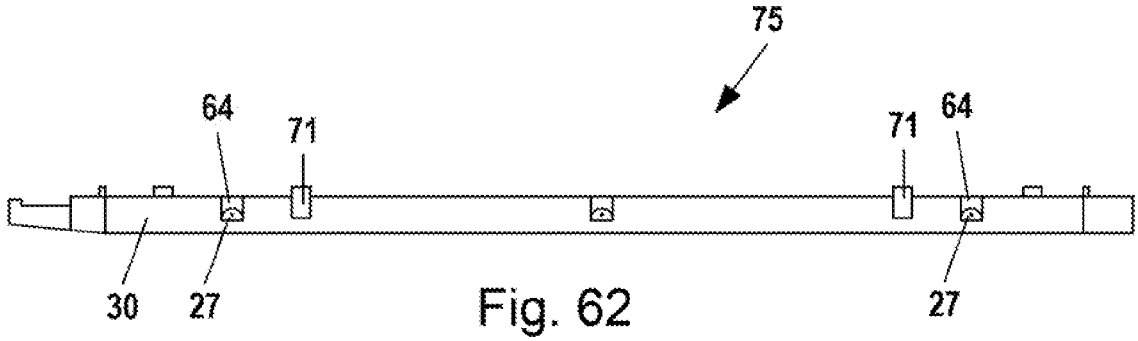
FIG. 62 depicts the right side of the platform module of FIG. 54.
Figure 63:
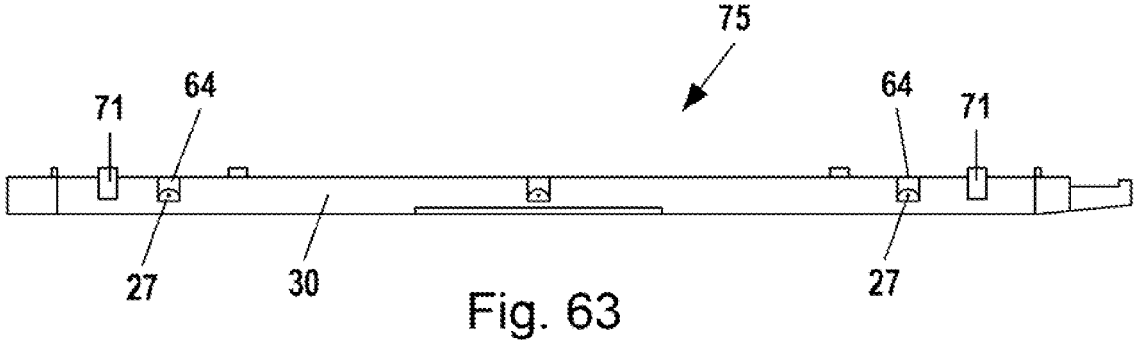
FIG. 63 depicts the left side of the platform module of FIG. 54.
Figure 64:
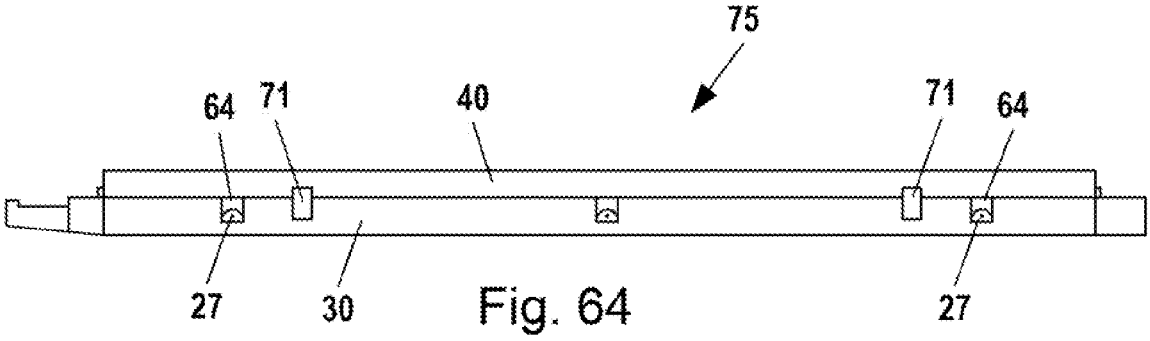
FIG. 64 depicts the right side of the platform module of FIG. 54, with a decorative layer included.
Figure 65:
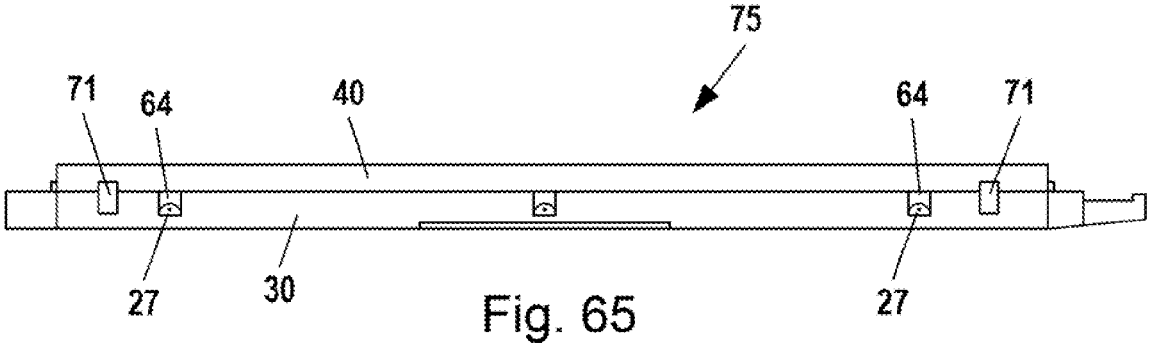
FIG. 65 depicts the left side of the platform module of FIG. 54, with a decorative layer included.
Figure 66:
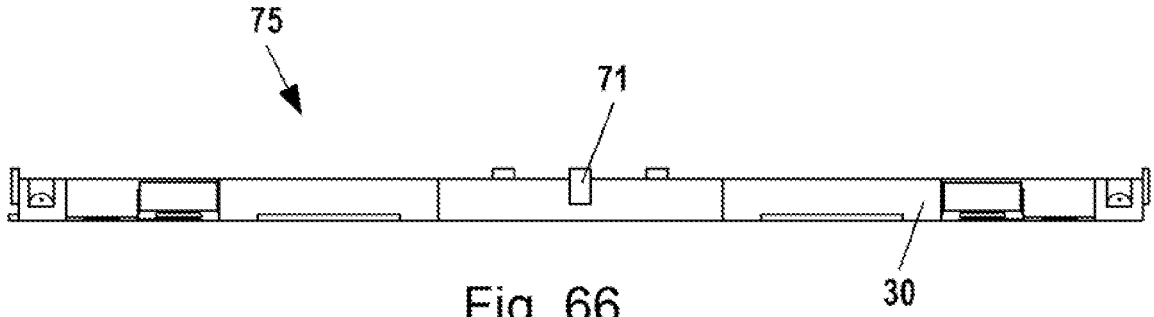
FIG. 66 depicts the front side of the platform module of FIG. 54.
Figure 67:
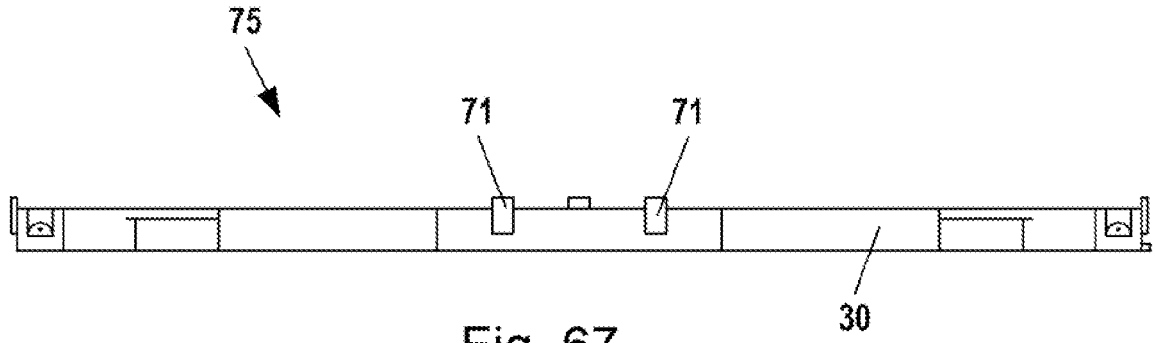
FIG. 67 depicts the back side of the platform module of FIG. 54.
Figure 68:
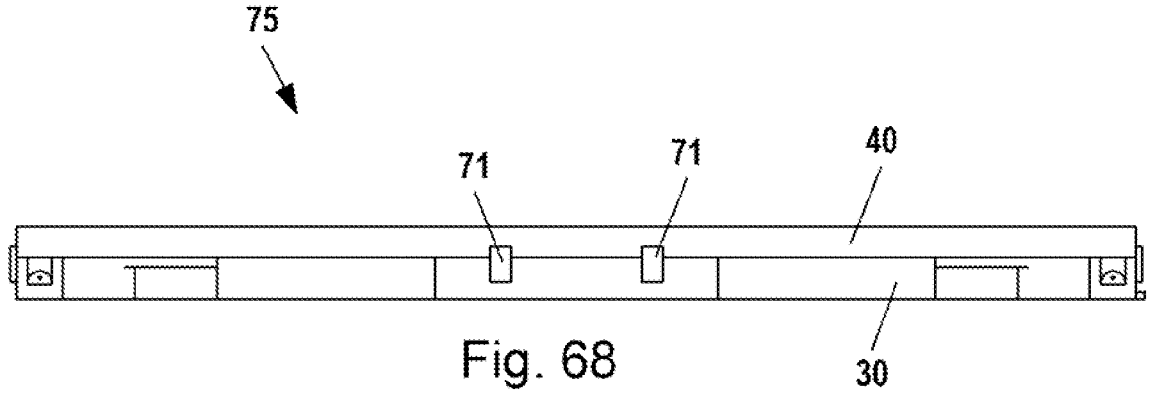
FIG. 68 depicts the front side of the platform module of FIG. 54, with a decorative layer included.
Figure 69:
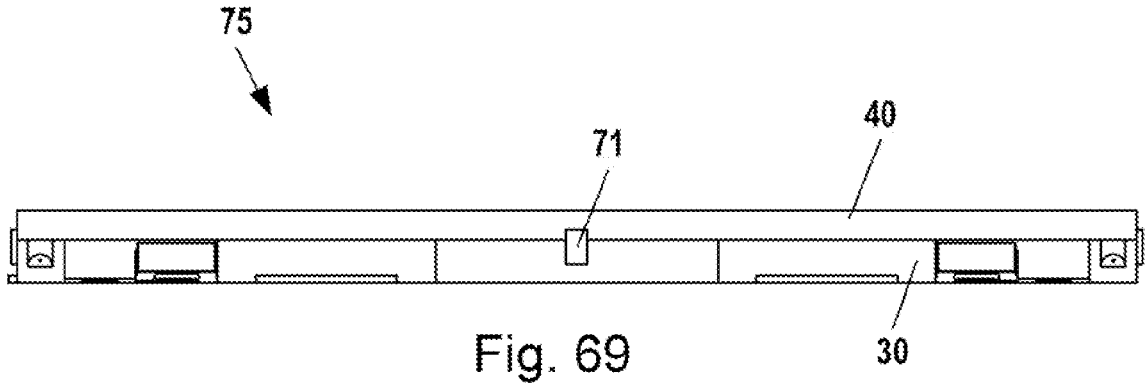
FIG. 69 depicts the back side of the platform module of FIG. 54, with a decorative layer included.
Figure 70:
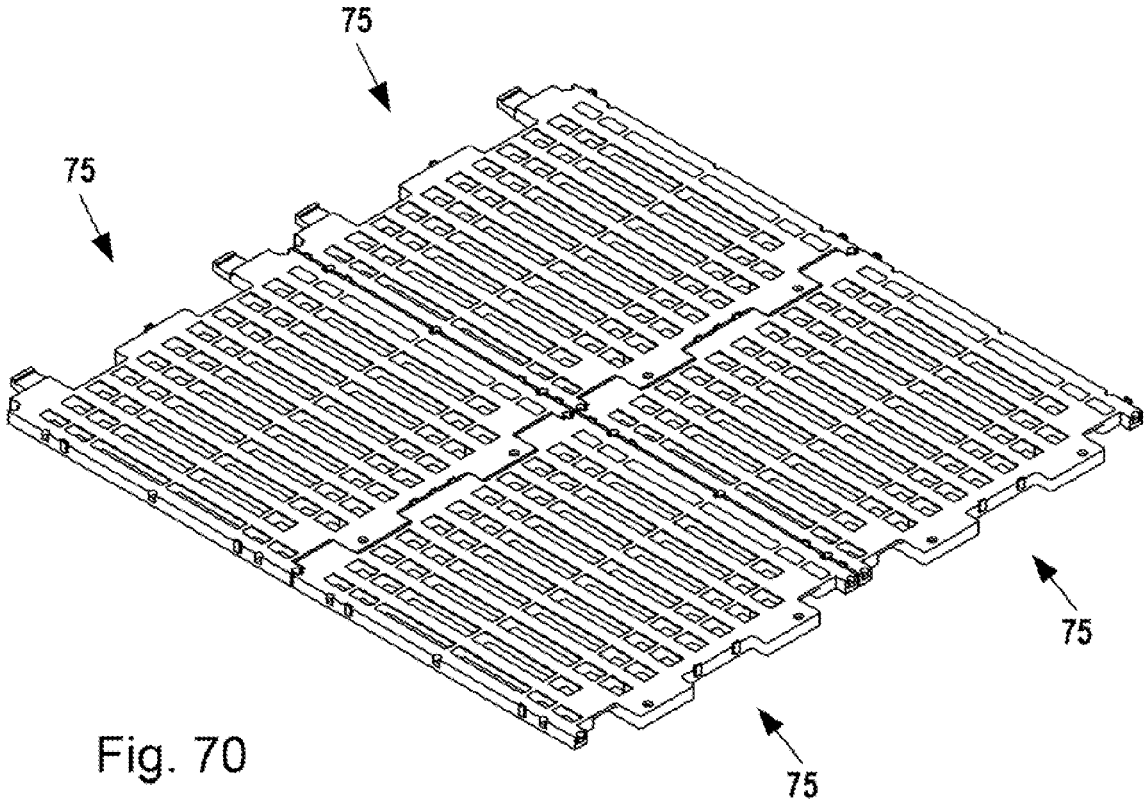
FIG. 70 is a top perspective view a set of the interlocking platform modules of FIG. 54.
Figure 71:
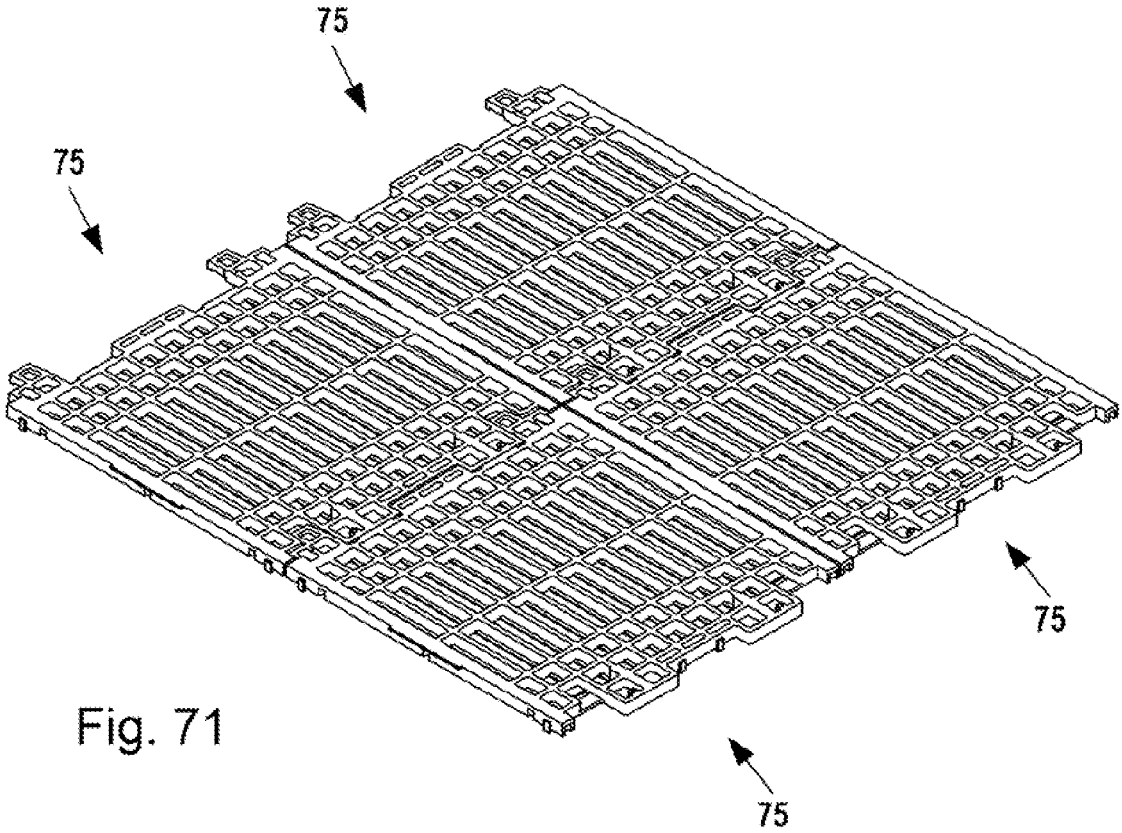
FIG. 71 is a bottom perspective view a set of the interlocking platform modules of FIG. 54.
Figure 72:
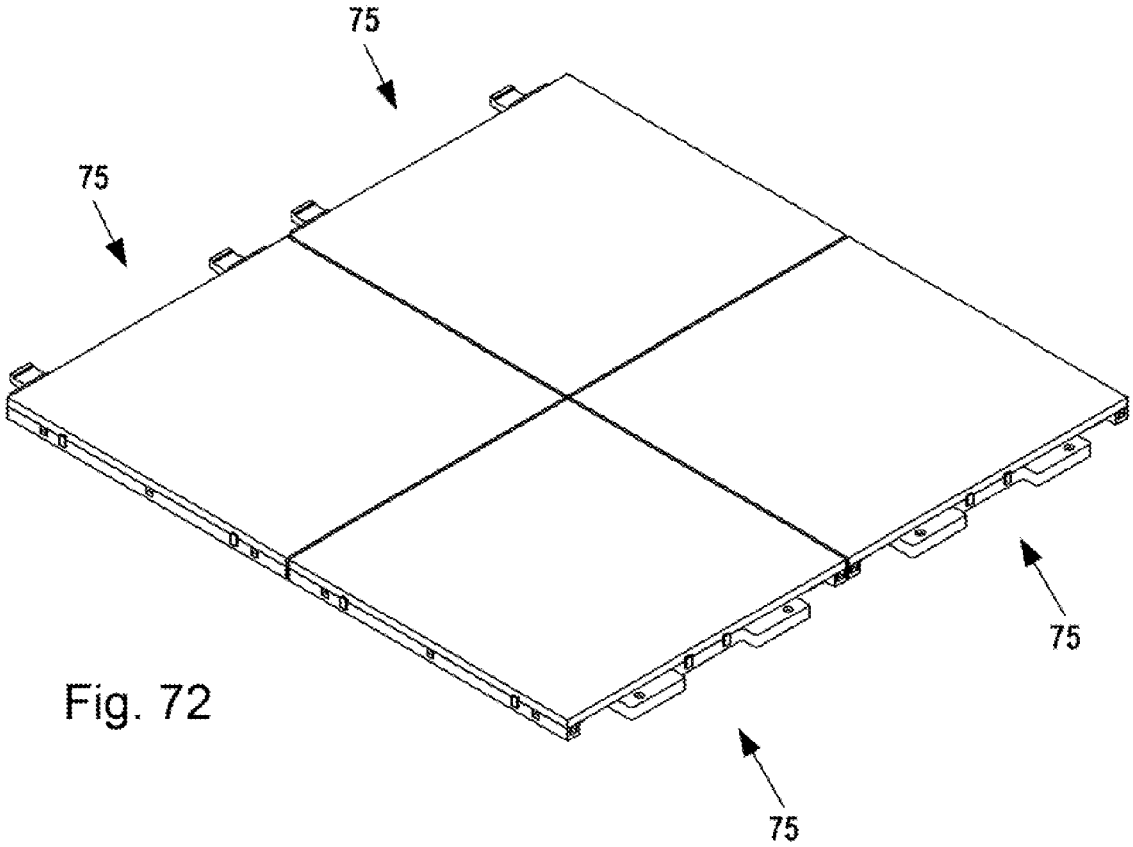
FIG. 72 is a top perspective view a set of the interlocking platform modules of FIG. 54, including the decorative top layers.

In any case, the structural platform 30 has a preferably lightweight construction, being made of lightweight plastic or another composite material, and manufactured as a single piece. The preferred form of manufacturing is through injection molding, although compression molding or any other suitable technique for molding polymeric resin may also be used. During formation, the structural platform 30 may be reinforced by pulling reinforced fibers through the resin. To further reinforce the structural platform 30 without significantly increasing its weight, each panel or module 10 is preferably formed with a reticulated structure. For example, FIGS. 2 and 23 illustrate a grid or reticulated structure of reinforcing ribs 33 on the underside 32 of the panel or module 10. In these examples, and as better illustrated in FIGS. 4 and 5, the panel or module 10 includes a substantially continuous, substantially planar top surface 20 over and integral with the grid of reinforcing ribs 33. FIGS. 54-61 illustrate a platform panel or module 10 with a grid- or lattice-like structural platform 30, comprising a plurality of longitudinal ribs 76 that intersect with lateral ribs 77. In these examples, the ribs 76 and 77 are not integrally formed with a substantially continuous, substantially planar top surface 20, although the platform 30 is preferably joined to a decorative top layer, surface, or veneer element 40 as illustrated in FIGS. 56 and 59.

The decorative top layer, surface or veneer element 40 may take any suitable form or composition, including but not limited to stone, ceramic, rubber, plastic, wood, paint, and dyes. Alternatively, it is comprised of the same material as the platform 30. Optionally, the top veneer element 40 is, with the exception of one or more shelf portions 41 (FIG. 3), a pattern molded, etched, or otherwise formed into the platform 30. For example, in injection molded embodiments of the platform panel or module 10, the decorative top layer, surface or veneer element 40 may be formed with the structural platform 30 in a common mold. Also, the decorative top layer, surface or veneer element 40 may be formed in a mold before, at the same time, or after the resin for the sublayer forming the structural platform 30 cures.

Preferably, the decorative top layer, surface or veneer element 40 conceals substantially all of the underlying platform 30 or any undecorated portion thereof, with the exception of one or more exposed platform sections 42 (FIG. 1) that are designed to be concealed beneath the shelf or shelves 41 of an identically-configured, identically-oriented adjoining platform panel or module 10. The decorative top layer, surface or veneer element 40 also conceals any screws or other fasteners used to mount the structural platform 30 to the joist substructure 90.

In several of the illustrated embodiments, each structural platform 30 includes a plurality of small orifices or apertures 31, approximately 1 mm in diameter and regularly spaced about 9 mm apart, by which the decorative top layer 40 is secured to the structural platform 30. The top layer 40, if not integral with the structural platform 30 itself, may be secured to the structural platform 30 with adhesive that engages at least some of, and preferably most of, the orifices 31. The adhesive, after it is applied to the platform 30, penetrates through a substantial number of the orifices or apertures 31 and mushrooms against the underside 32 of the platform 30. This creates a mechanical, as well as adhesive, attachment of the top layer 40 to the structural platform 30.

While the orifices or apertures 31 are especially suitable for adhesive attachment, they also facilitate fastening of a top decorative layer 40 or other objects to the platform panel or module 10 via screws, nails, or other fasteners. The orifices or apertures 31 also reduce the weight and mass of the platform panel or module 10 without materially diminishing its strength.

Figure 73:
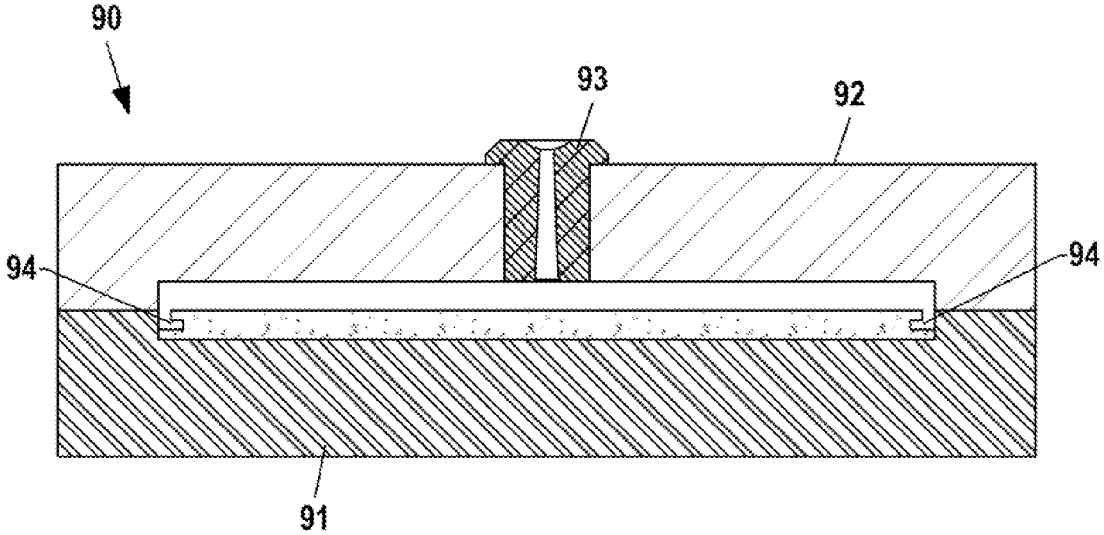
FIG. 73 illustrates an injection mold with stone decorative surface inserted into the mold, for fabricating a platform panel or module.
Figure 74:
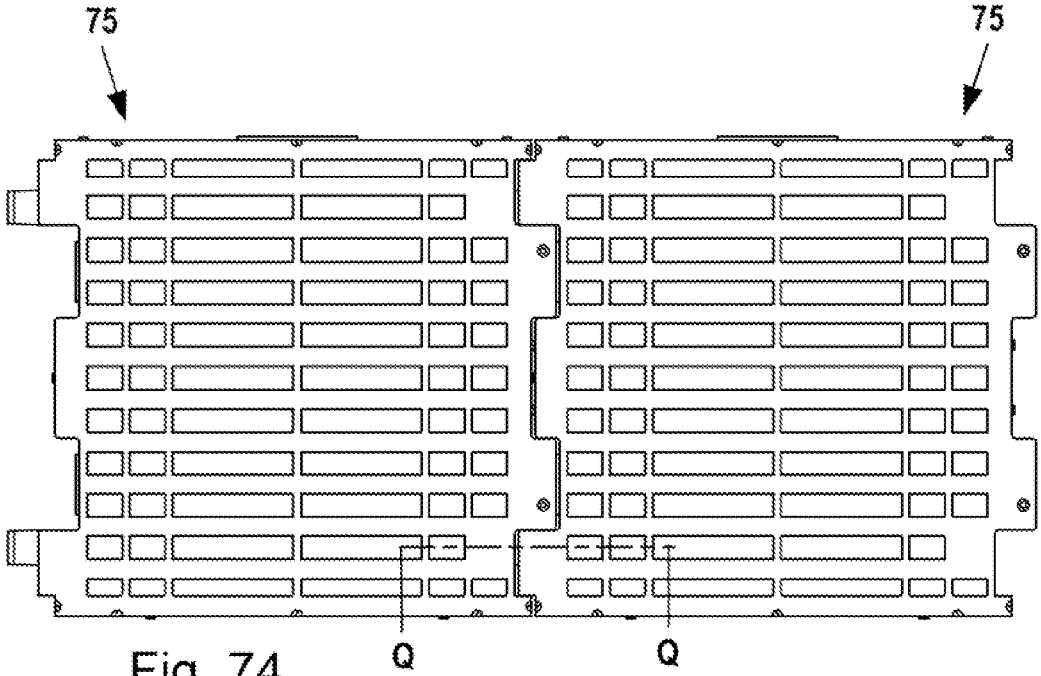
FIG. 74 is a top plan view of an interlocked pair of the platform modules of FIG. 54.

The illustrated orifices or apertures 31 would preferably be omitted from embodiments (not shown) in which the decorative top layer, surface, or veneer element 40 is integral with the platform 30, or in embodiments in which the platform 30 is molded directly onto the decorative top layer, surface, or veneer element 40. For example, FIG. 73 illustrates a mold 90 for one manufacturing embodiment for fabricating the platform panel or module 10. The mold 90 comprises a movable plate 91, a stationary plate 92, and a sprue bushing 93. Notches or recesses 94 are cut into the sides of a stone intended to be used as top layer 40 for a platform panel or module 10. The stone is inserted into the mold 90 prior to the molding process. Then plastic resin 89 is injected through the sprue bushing 93 into the mold. Some of the resin 89 is forced to flow into the notches or recesses 94 of the stone. Then the resin 89 cures, forming the structural platform 30, with some of the plastic molded into the recesses 94, creating a composite plastic/stone platform panel or module with a strong mechanical connection between the platform 30 and the stone top layer 40.

Each platform panel or module 10 is adapted to span and mount to the top surfaces of two substantially parallel, spaced-apart in-line span joists 6 (see FIGS. 36-40). As such, each platform panel or module 10 comprises two joist-spanning sides 11 and 12 and two complementary panel- or module-coupling sides 13 and 14 that engage the in-line span joists 6 along much of the length of the sides 13 and 14. The complementary panel- or module-coupling sides 13 and 14 are separated by a distance approximately equal to the distance between two adjacent parallel in-line span joists 6 (typically, 406 mm or 16 inches from center to center) of a joist substructure 1 for which the panel or module 10 is intended.

Figure 3:
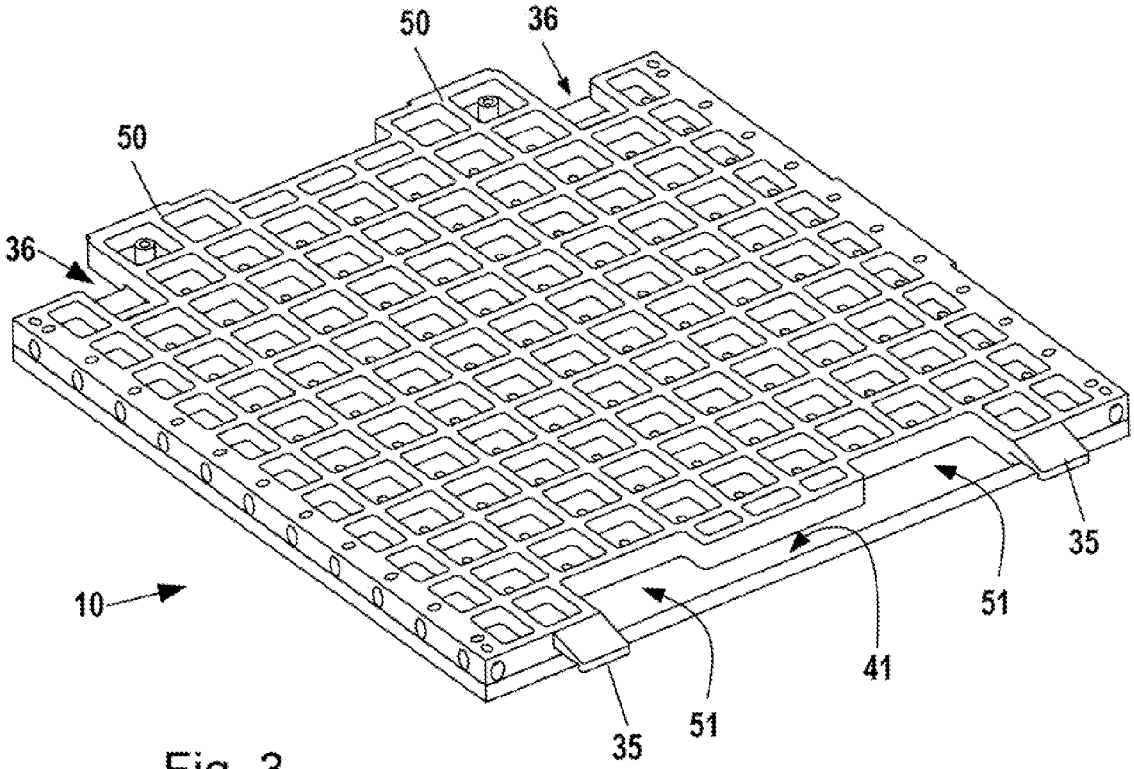

There are multiple ways in which to characterize the complementary panel- or module-coupling sides 13 and 14. FIG. 3 illustrates the panel- or module-coupling side 13 as having a plurality of protruding male members 50, and the opposite panel- or module-coupling side 14 as having a plurality of complementary female recesses 51 that extend inwardly, underneath a shelf portion 41 of the decorative top layer 40. Notably, while the decorative top layer 40 preferably has a convex polygonal profile, the supporting structural platform 30 preferably has a concave polygonal profile, to define the male members 50 and the female recesses 51.

When the platform panel or module 10 is installed over a supporting substructure 1 and adjoined on opposite panel-coupling sides 13 and 14 with first and second identically-configured and identically-oriented platform panels or modules 10, the female recesses 51 are aligned with the male members 50 of the first adjoining panel or module 10. Also, the shelf portion 41 of the decorative top layer 40 conceals and is supported by the male members 50 of the first adjoining panel or module 10. Furthermore, the male members 50 are aligned with the female recesses 51 of the second adjoining panel or module 10 and concealed underneath the shelf portion 41 of the second adjoining panel or module 10.

Figure 13:
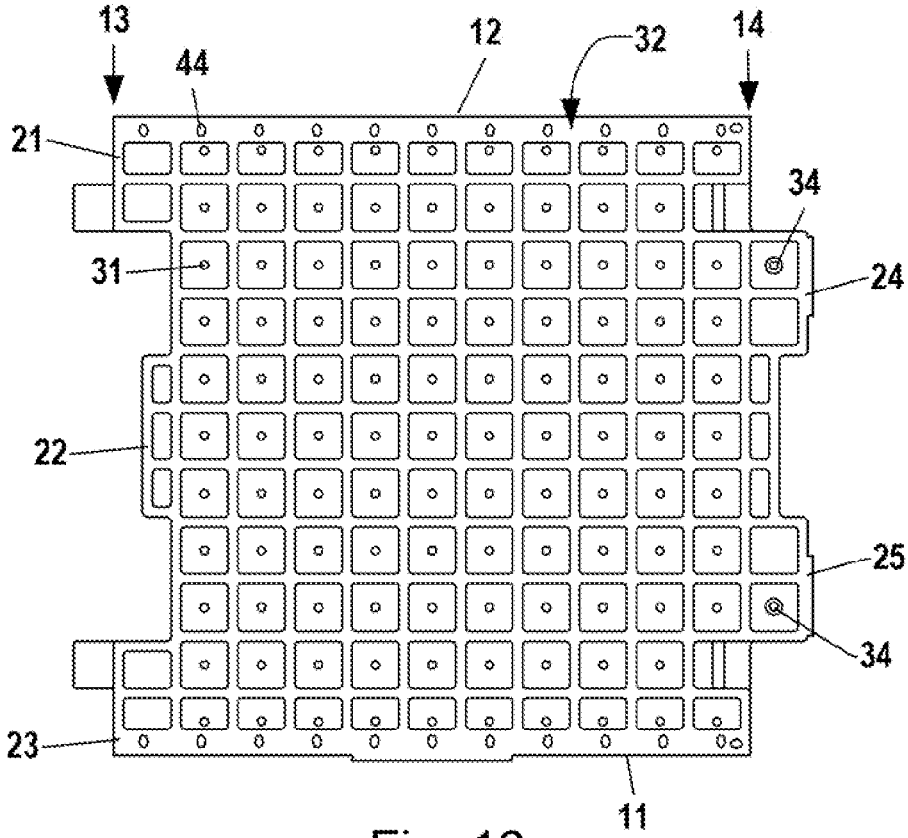
FIG. 13 is a bottom view of the platform panel or module of FIG. 4.

FIG. 13 illustrates panel- or module-coupling side 13 as having an odd number of (for example, three) tabs 21, 22, and 23, and the opposite panel- or module-coupling side 14 as having an even number of (for example, two) tabs 24 and 25. The tabs 21, 22, and 23 of any given platform panel or module 10 are configured to intersect with tabs 24 and 25 of another identically-formed platform panel or module 10.

Figure 15:
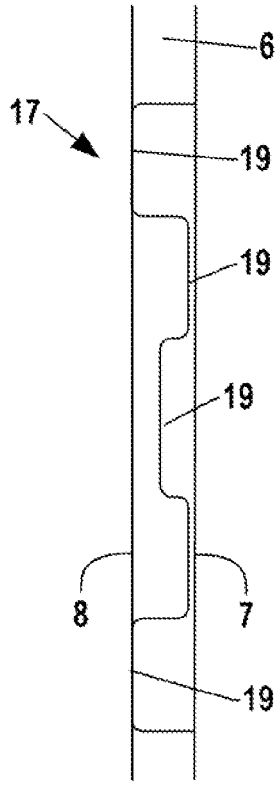
FIG. 15 illustrates the crenellated, nonlinear profile of one of the panel-coupling sides of the platform panel or module of FIG. 4.
Figure 16:
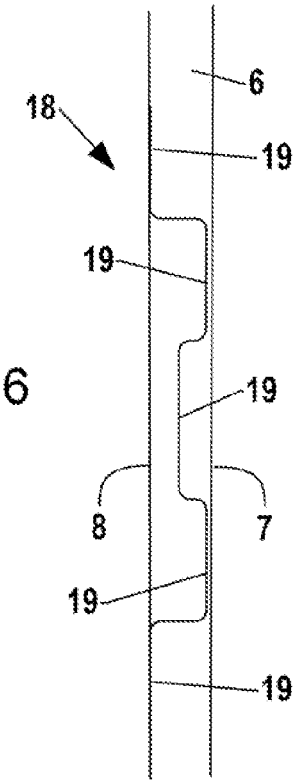
FIG. 16 illustrates the complementary nonlinear profile of the opposite panel-coupling side of the platform panel or module of FIG. 4.
Figure 17:
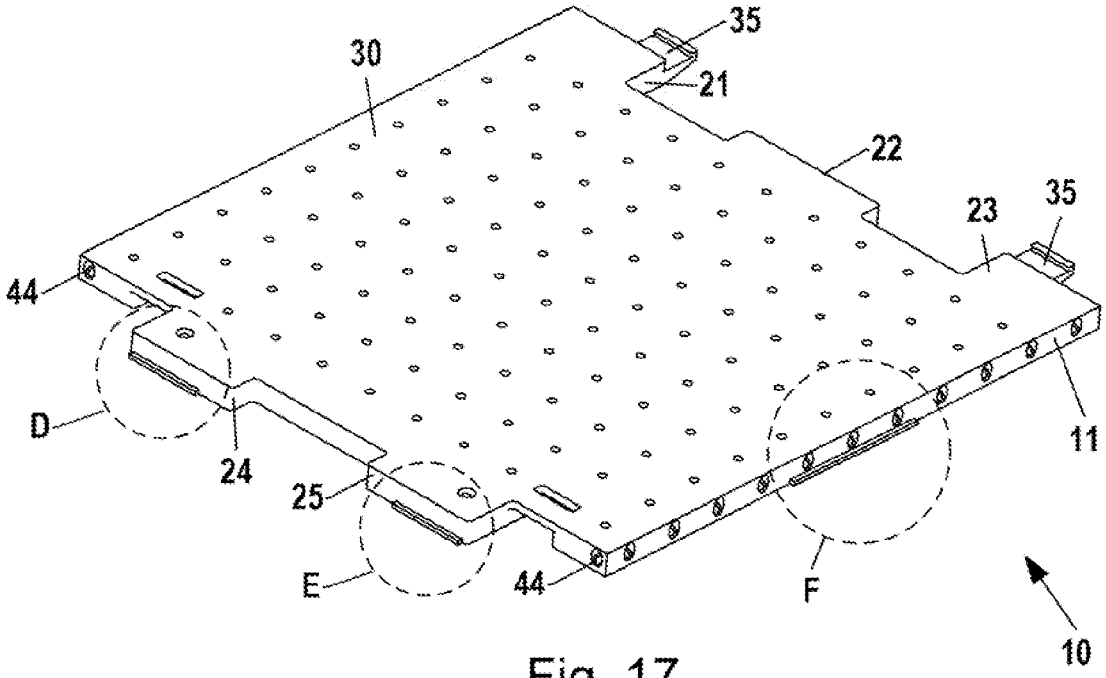
FIG. 17 is another top perspective view of the platform panel or module of FIG. 4.
Figure 18:
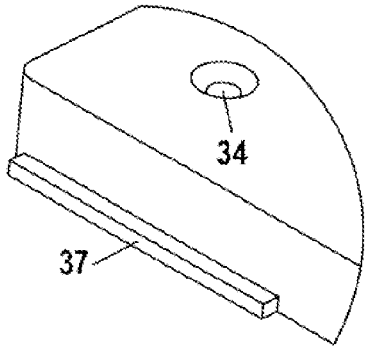
FIG. 18 is an enlarged view of the section designated "D" in FIG. 17.

FIGS. 15 and 16 illustrate the panel- or module-coupling sides 13 and 14 as comprising complementary nonlinear profiles 17 or 18. Put it another way, each profile 17 or 18 is configured to align with its opposite, complementary profile 18 or 17, on an identically-configured adjacent platform panel or module 10. Also, each profile 17 or 18 comprises a plurality of linear segments 19 that, when the platform panel or module 10 is mounted to joists 6, lie adjacent opposing edges 7 and 8 of the top surface of the joist 6 to which the panel- or module-coupling side 13 or 14 is mounted. Even more particularly, each profile 17 or 18 preferably has a crenellated or castellated form, enabling the platform panel or module 10 to distribute its load in a relatively disperse, less concentrated manner. However, it will be understood that a variety of nonlinear profiles 17 and 18 are available to accomplish the same result.

Figure 8:
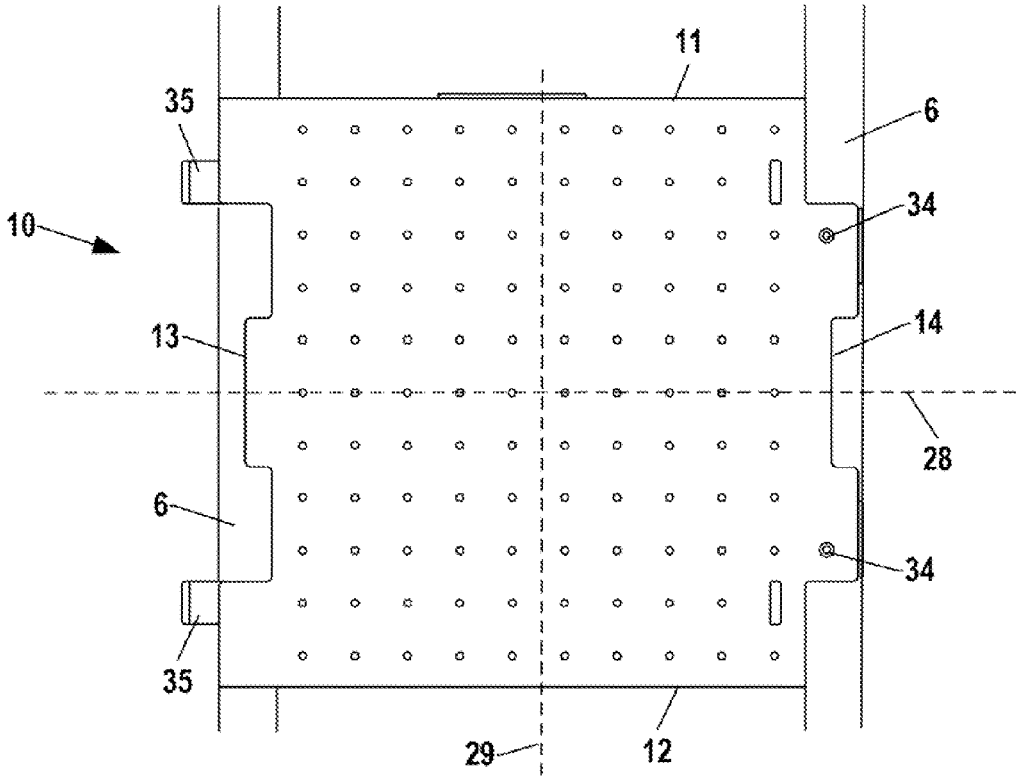
FIG. 8 is a top plan view of the platform panel or module of FIG. 5 mounted on two joists.

FIGS. 8, 15, and 16 illustrate how the platform panels or modules 10 are configured so that the full breadth of each joist 6 supports the panel or module 10. This obviates the need to install a joist plate prior to the installation of the panel or module 10. In contrast to prior art designs that enable only one-half of the breadth of each joist to support the panel or module, each complementary panel- or module-coupling side 13 and 14 of panel or module 10 has a nonlinear profile 17 or 18 configured to cross back and forth between opposing edges 7 and 8 of the top surface of the joist 6 to which the panel or module 10 is mounted. Also, each panel- or module-coupling side 13 and 14 is preferably configured so that the panel or module 10 is adapted to be supported by approximately one-half of an area, between the two joist-spanning sides 7 and 8, of the top surface of each spanned joist 6.

Each platform panel or module 10 can also be characterized as having a geometry that is substantially symmetric with respect to the center axis 28 (FIG. 8) perpendicular to the joists 4, 5 and 6 but asymmetric with respect to an orthogonal center axis 29 parallel to the joists 4, 5, and 6. The specific geometry permits adjacent platform panels or modules 10 to be interlocked together, while still providing each platform panel or module 10 with the support of the full width of each joist 4, 5, or 6 on which it is mounted.

Each platform panel or module 10 is designed so that it need be fastened to only one of the two joists 5 or 6 it spans. It may be held to the opposite joist 5 or 6 by nothing other than another platform panel or module 10 with which it is interlocked. The only exception is with respect to platform panels or modules 10 that span the beginning of sequence rim joist 4 and its adjacent in-line span joist 6. Those platform panels or modules 10 should be fastened to both joists 4 and 6.

Figure 5:
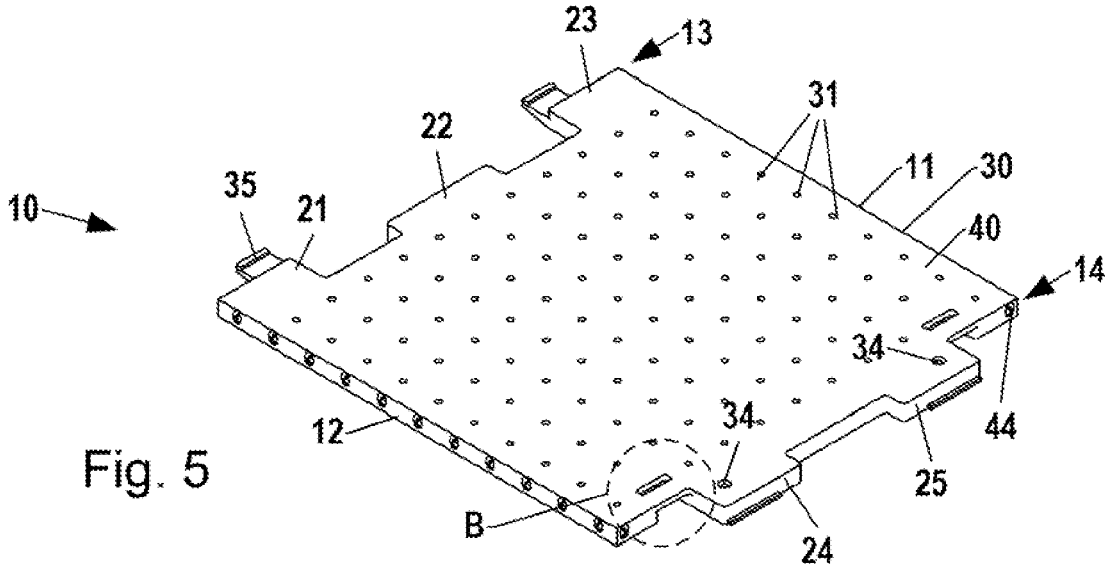
Figure 42:
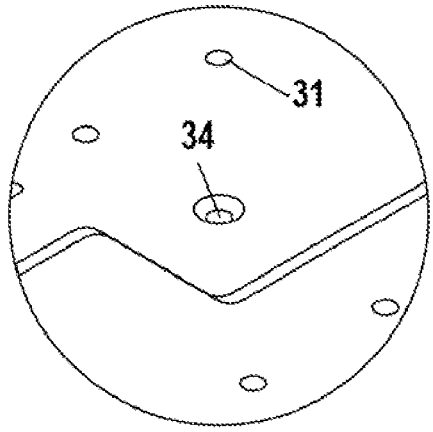
FIG. 42 is an enlarged view of the section designated "N" in FIG. 38.

As illustrated in FIG. 5, tabs 24 and 25 of panel- or module-coupling side 14 include large fastener guides or vertical mounting holes or pockets 34 for receiving threaded fasteners 53 (preferably, #8×6.35 cm. screws), to secure the platform panel or module 10 to one of the in-line span joists 6. The vertical mounting holes or pockets 34 may be tapered, as illustrated in FIG. 42.

Figure 41:
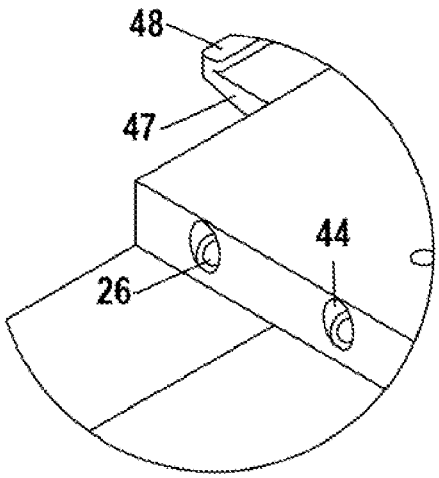
FIG. 41 is an enlarged view of the section designated "M" in FIG. 38.
Figure 43:
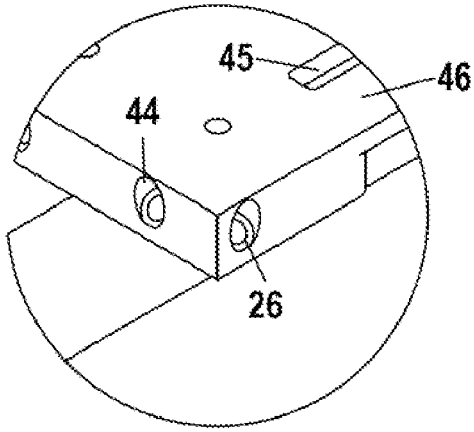
FIG. 43 is an enlarged view of the section designated "O" in FIG. 38.

The panel- or module-coupling side 14 also includes a pair of diagonally-oriented mounting pockets 44 to fasten an end-of-sequence panel to an end-of-sequence rim joist 5. In the embodiments illustrated in FIGS. 6, 41, and 43, each pocket 44 includes a through-hole or pilot hole 26 that extends all the way to the underside 32 of the platform panel or module 10. The embodiments illustrated in FIGS. 54 and 62-65 provide functionally equivalent pockets 64 that include a centering dimple or indentation 27—identical or equivalent to a pilot hole—for guiding a fastener or drill.

The fasteners 53 (FIGS. 37-38), whether inserted through the vertical mounting holes 34 or the diagonal mounting holes or pockets 44, positively attach the platform panel or module 10 to the joist substructure 1 and restrict movement of the platform panel or module 10 in both the vertical and horizontal directions. By contrast, the tabs 21, 22, and 23 of platform panel- or module-coupling side 13 preferably do not include any vertical mounting holes or pockets 34. Rather, the male connectors 35 or 55, when interconnected with the female receptacles 36 or 56 of an adjoining platform panel or module 10, suffice to secure side 13 to the opposing in-line span joist 6.

Each panel- or module-coupling side 13 and 14 is also configured to adjoin and interlock with the complementary panel- or module-coupling side 14 or 13 of another identically-formed and identically-oriented platform panel or module 10.

Figure 6:
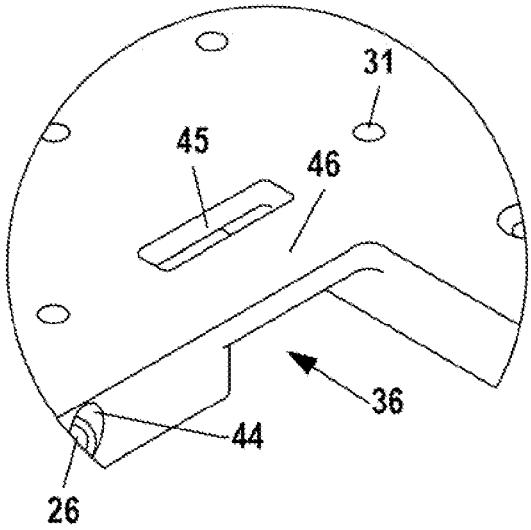
FIG. 6 is an enlarged view of the section designated "A" in FIG. 4.
Figure 7:
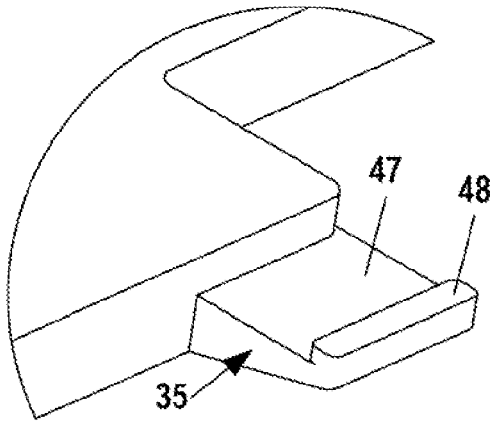
FIG. 7 is an enlarged view of the section designated "B" in FIG. 5.

As shown in FIGS. 1-26, and especially FIGS. 6 and 7, each platform panel or module 10 comprises one or more, and preferably two, male connectors 35 (distinct from the previously-discussed male members 50) extending outwardly from panel- or module-coupling side 13 and a corresponding number, placement, and complementary configuration of female receptacles 36 (distinct from the previously-discussed female receptacles 51) extending inwardly from the opposite panel- or module-coupling side 14.

Figure 26A:
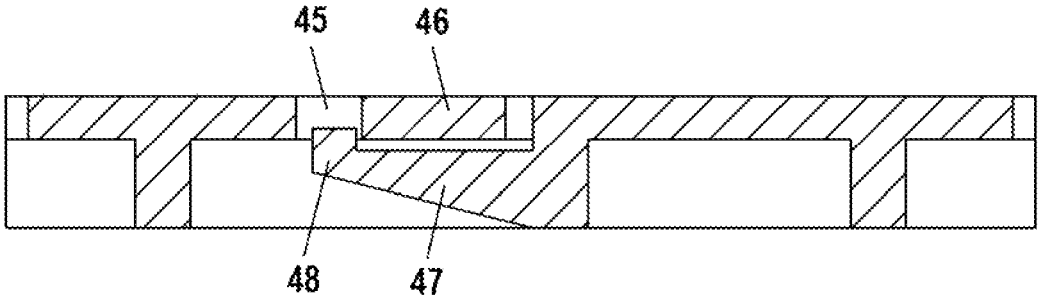
FIG. 26A is a partial cross-sectional view taken along line H-H of FIG. 25.
Figure 26B:
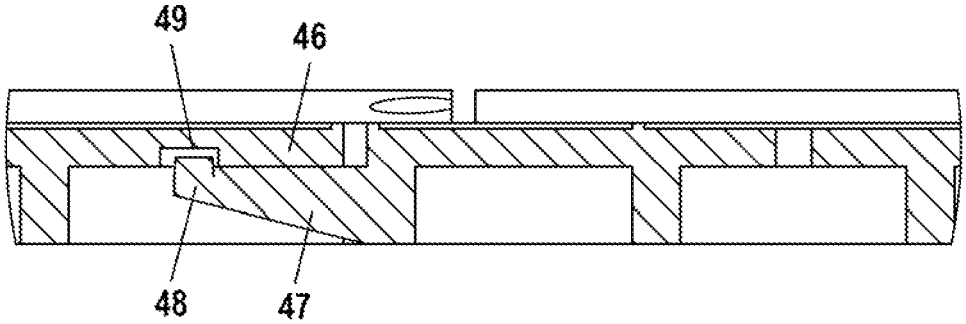
FIG. 26B is a partial cross-sectional view along the same line H-H, but using a slightly modified platform panel or module design.
Figure 27:
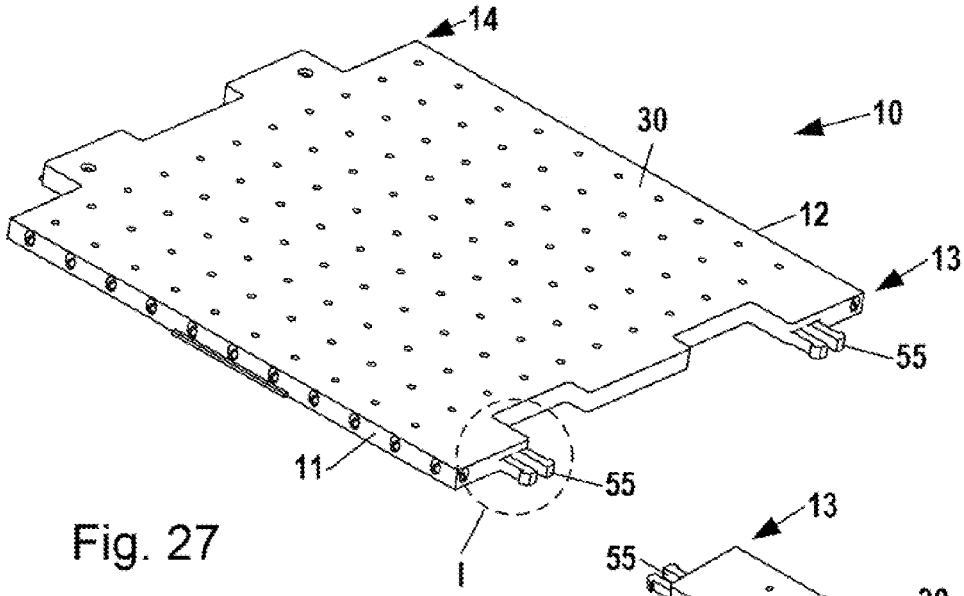
FIGS. 27 and 28 are top perspective views of another embodiment of a platform panel or module, without a decorative veneer, with an alternative set of male and female connecting members.
Figure 28:
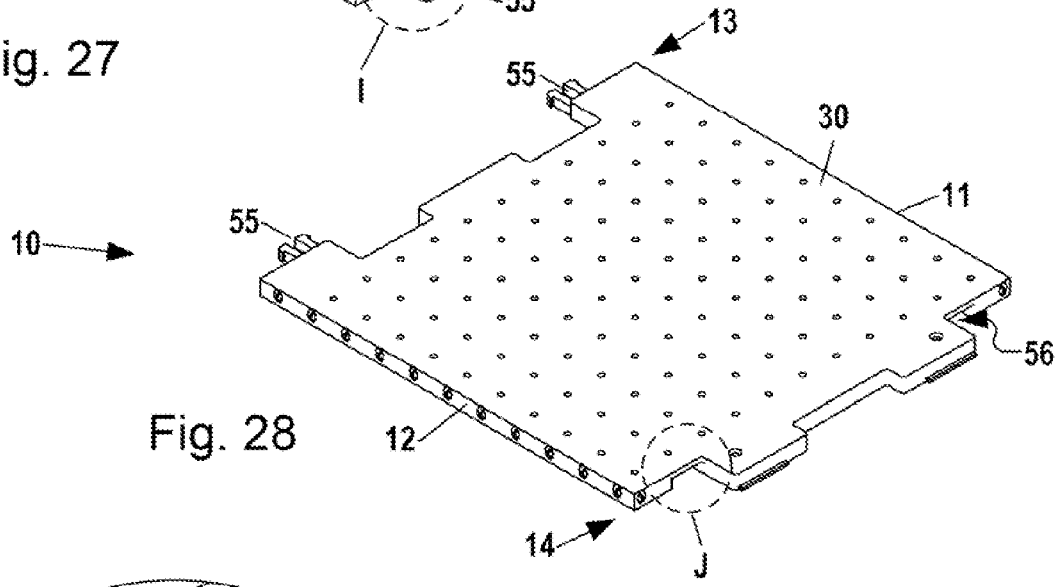
Figure 29:
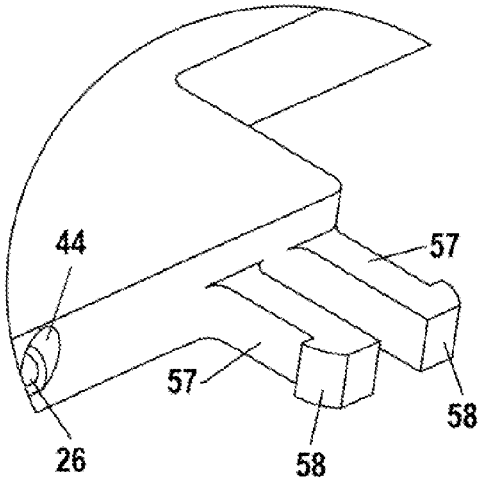
FIG. 29 is an enlarged view of the section designated "I" in FIG. 27.
Figure 30:
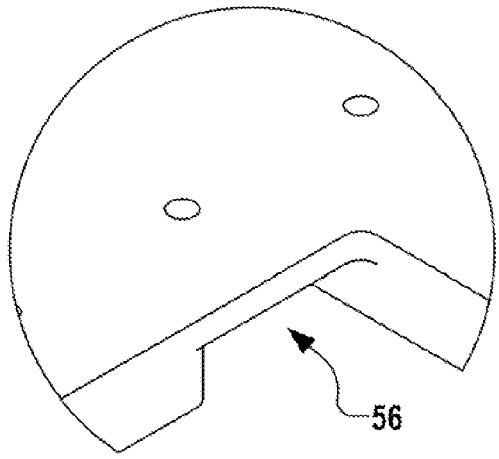
FIG. 30 is an enlarged view of the section designated "J" in FIG. 28.
Figure 31:
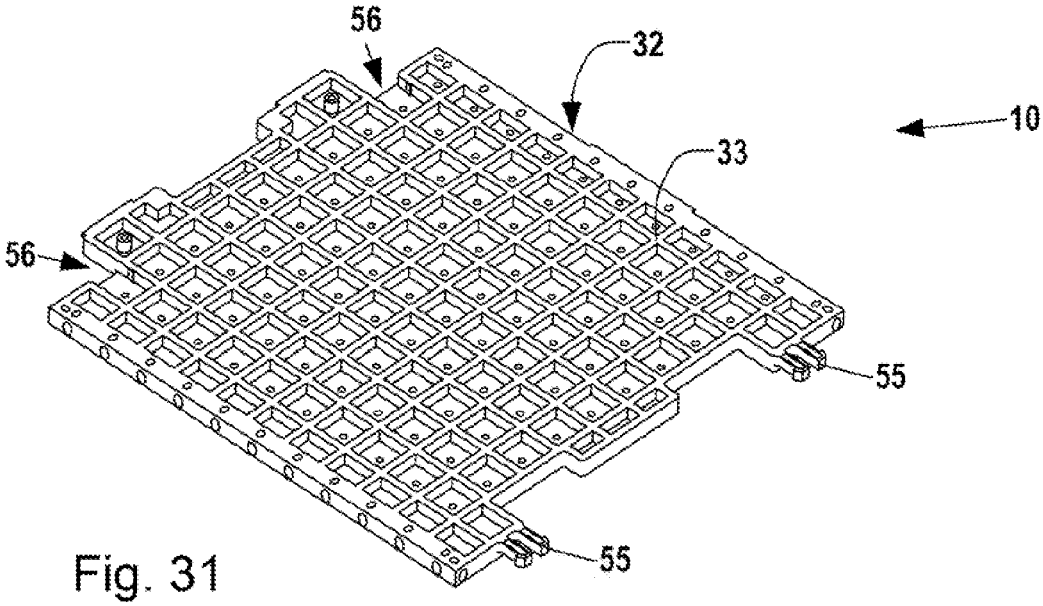
FIG. 31 is a bottom perspective view of the platform panel or module of FIGS. 27-28.
Figure 32:
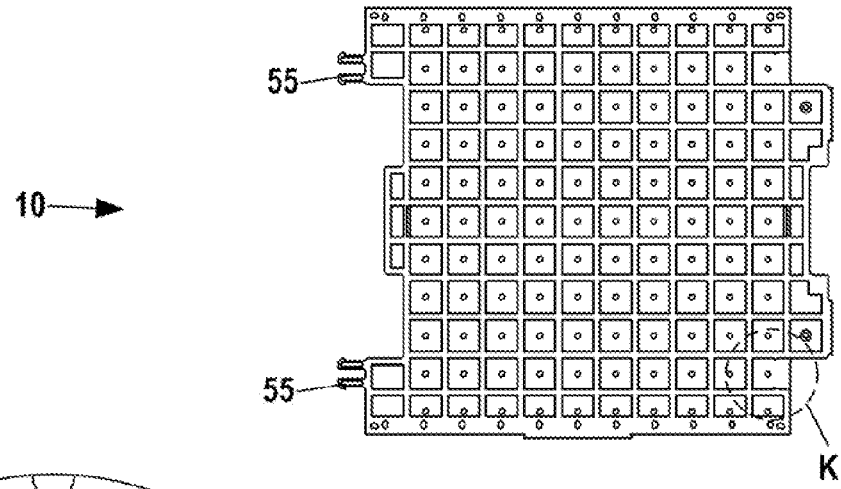
FIG. 32 is a bottom view of the platform panel or module of FIG. 31.
Figure 33:
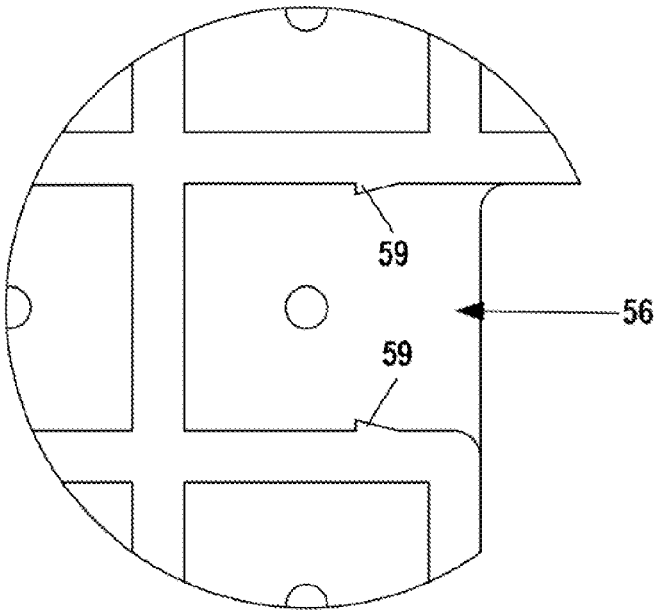
FIG. 33 is an enlarged view of the section designated "K" in FIG. 32.
Figure 34:
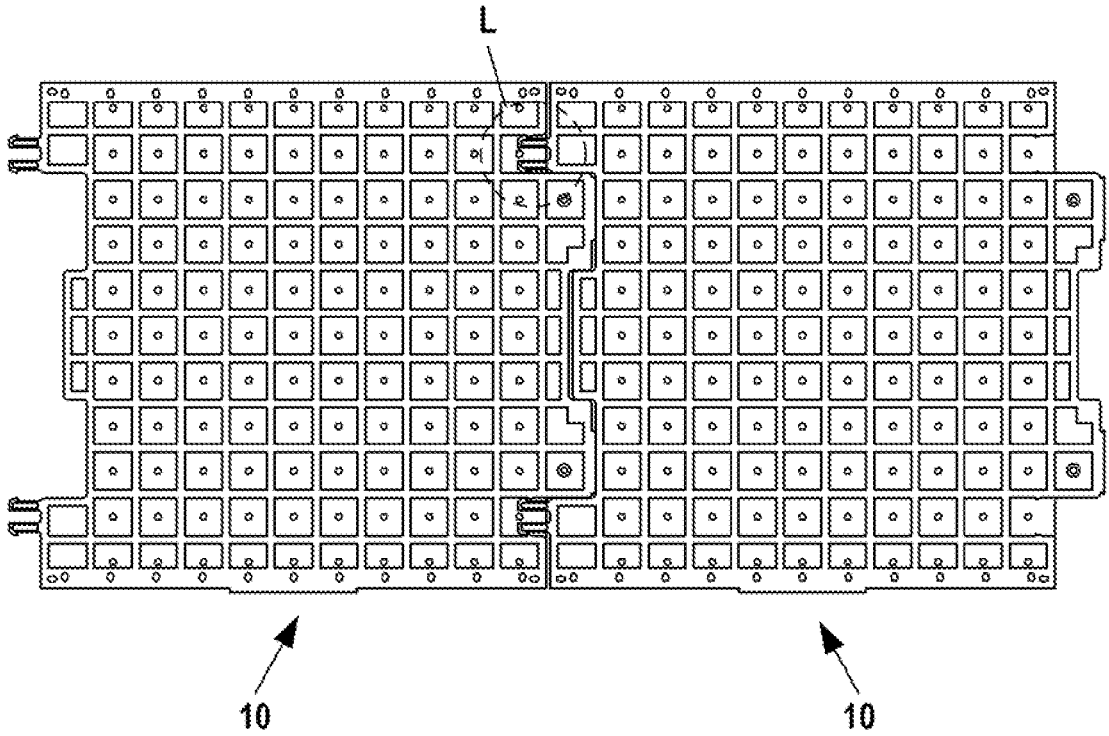
FIG. 34 is a bottom perspective view of an interlocking pair of FIG. 24's platform panels or modules.
Figure 35:
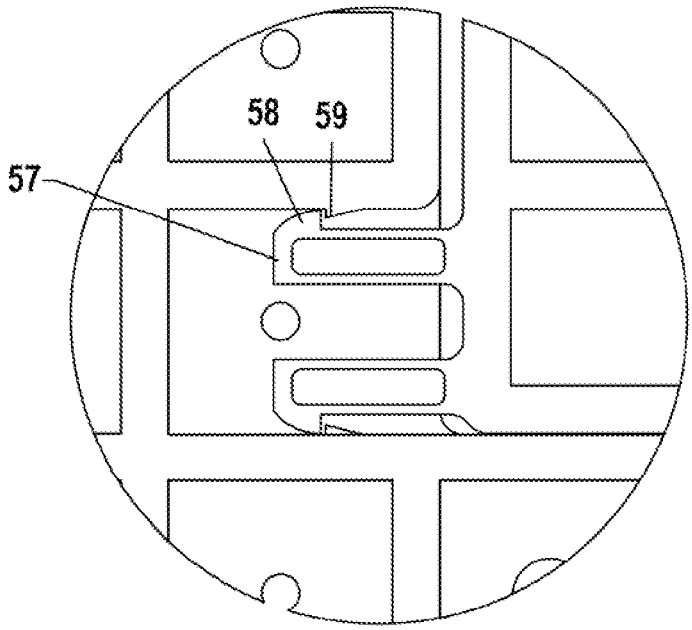
FIG. 35 is an enlarged view of the section designated "L" in FIG. 34.

In these embodiments, each male connector 35 comprises a single tab 47—which is preferably resilient but may be flexible—with an upwardly extending tongue or protuberance 48 (FIG. 7). Each corresponding female receptacle 36 comprises a catch 49 or opening 45 in the structural sublayer 30 dimensioned to engage the tongue 48 of the male connector 35 (FIG. 6). The catch 49 or opening 45 defines a shelf 46 operable to secure the mating male connector 35 of an adjoining platform panel or module 10. FIGS. 26A and 26B illustrate, in partial cross-section, the interconnection of male connectors 35 with female receptacles 36 in adjoining platform panels or modules 10.

FIGS. 22-26B illustrate how a second platform panel or module 67 can be pivoted into interlocking relationship with a first platform panel or module 66. After the first platform panel or module 66 is installed over a supporting substructure, the second platform panel or module 67 is tilted and translated to position its male connectors 35 underneath the female receptacles 36 of the first platform panel or module. Then, the second platform panel or module 67 is dropped toward a level position, coplanar with the first platform panel or module 66, in a manner that positively engages the male connectors 35 with the female receptacles 36 (FIG. 26A, 26B). After securing the platform panels or modules 10 together, the opposite side of the platform panel or module 10 is screwed to the joist. The platform panel or module 10 can be disengaged just as easily as it is engaged: by unscrewing the opposite side of the platform panel or module 10 from its joist, tilting the platform panel or module 10 back up (FIG. 23) and then translating the platform panel or module 10, in the lateral direction, away from the first platform panel or module 66.

Figure 75:
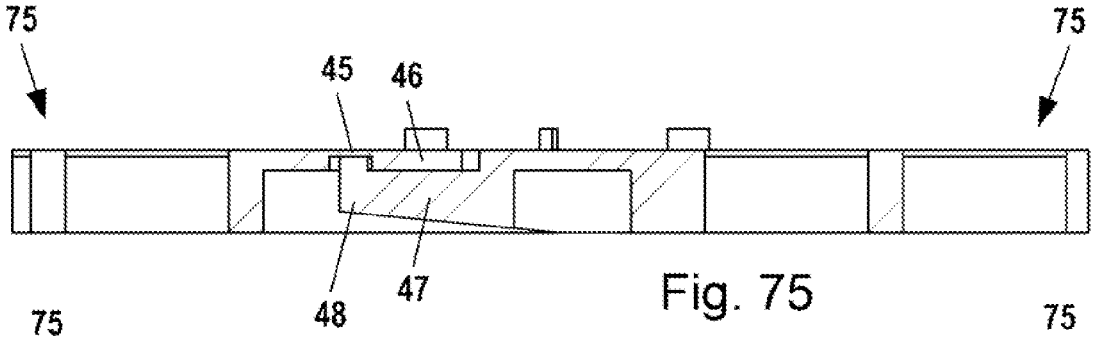
FIG. 75 is a partial cross-sectional view taken along line Q-Q of FIG. 74.
Figure 76:
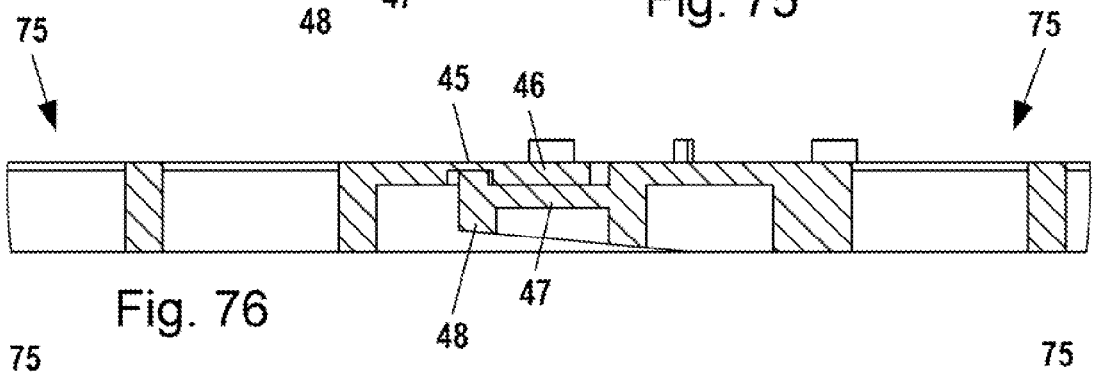
FIG. 76 is a partial cross-sectional view taken along line Q-Q of FIG. 74, but with a modified tab structure.
Figure 77:
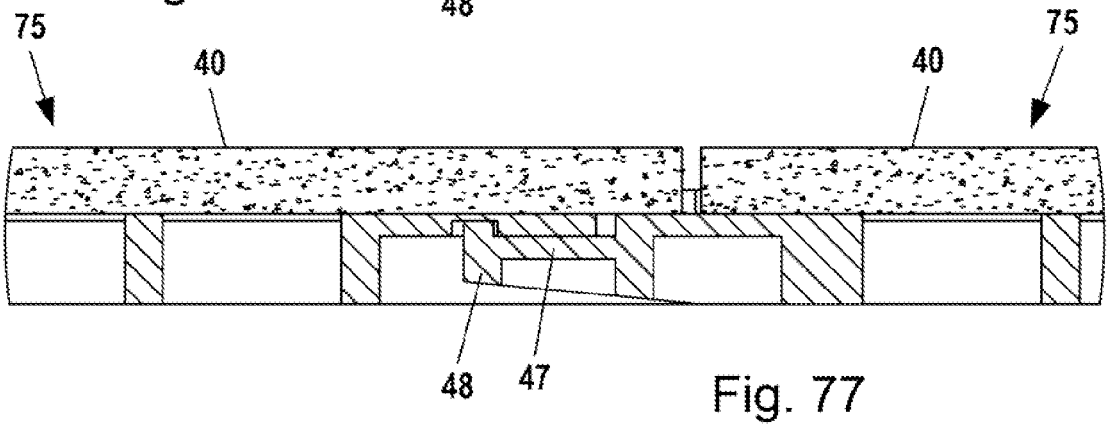
FIG. 77 is a partial cross-sectional view like the one shown in FIG. 76, but including a stone overlay.
Figure 78:
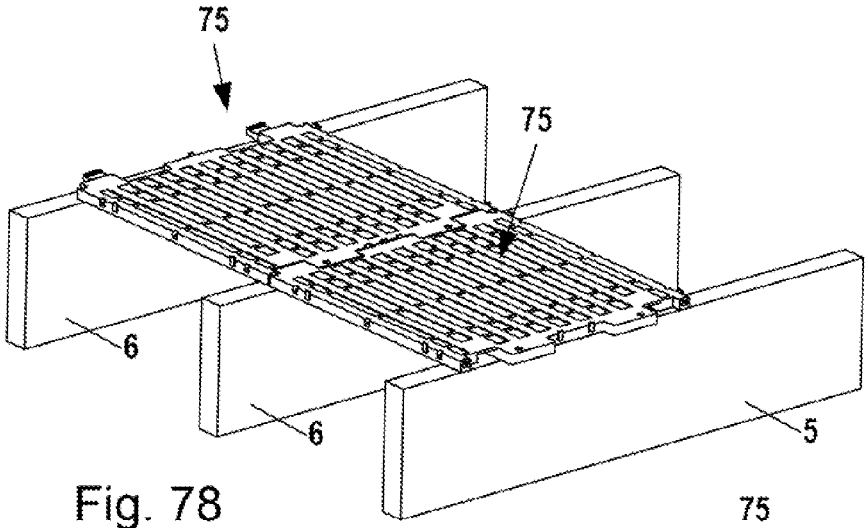
FIG. 78 is a perspective view of an interlocked pair of the platform modules of FIG. 54 installed over a joist substructure, with the diagonal fasteners omitted from view.

FIGS. 75-77 illustrate similar but slightly improved tab and receptacle structures in connection with another embodiment of the platform module 75. First, the tab 47 has a longer bevel, better enabling the module 75 to be tilted and translated into position. Second, the tab 47 in FIGS. 76-77 has a thinner midsection than the tab 47 shown in FIGS. 26*a*, 26B and 75, reducing the weight the module and providing greater flexibility to the tab 47.

FIGS. 27-35 illustrate a platform panel or module 10 with an alternative interlocking embodiment. The platform panel or module 10 of FIGS. 27-35 also comprises one or more, and preferably two, male connectors 55 protruding from the panel- or module-coupling side 13 and a corresponding number, placement, and complementary configuration of female receptacles 56 extending inwardly from the opposite panel- or module-coupling side 14. In this embodiment, each male connector 55 comprises a clip taking the form of a pair of flexible, resilient arms 57 with shoulder portions 58 that project outward from side faces of the arms 57. Each female receptacle 56 includes outside shelves, pawls, or wedges 59 (FIG. 35) protruding out of the sides of the receptacle 56. The outside shelves, pawls, or wedges 59 are configured to flex the arms 57 as they are inserted. The outside shelves, pawls, or wedges 59 also allow the arms 57 and their shoulder portions 58 to snap back outward into engagement with the female receptacle 56 after the shoulder portions 58 travel past the wedges 59. Thereafter, the outside shelves, pawls, or wedges 59 retain the arms in place.

To disengage the connection of two platform panels or modules 10 of the type illustrated in FIGS. 27-35, sufficient force is applied to cause the arms 57 to again flex inward, enabling removal of the male connector 55 from the female receptacle 56. Both the shoulder portions 58 and the wedges 59 may be angled or ramped to modify the amount of disengaging force required.

In both embodiments, each male connector 35 or 55 is adapted to interlock with a corresponding female receptacle 36 or 56 of an adjacent, identically-formed modular surface platform panel or module 10. Both embodiments include members configured to releasably secure the two adjoined platform panels or modules 10.

Notably, the male connectors 35 or 55 and female receptacles 36 or 56 are preferably placed on the sides 13 and 14 of the platform panel or module 10 in a manner configured to mount directly to the side rim joists 4 or inline span joists 6. Consequently, the platform panels or modules 10 interlock in a lateral direction across—rather than merely in a longitudinal direction along—multiple parallel, spaced-apart joists 4, 5 and 6. This contrasts with the less-preferred alternative of merely using male/female interlocking members for connecting adjoining platform panels or modules that are mounted on the same two joists. The preferred design is better at facilitating the consistent and symmetrical spacing and alignment of the platform panels or modules 10 over the entire joist substructure 1. After all, the limited width (typically about 38 mm or 1½ inch) of each side rim or span joist 4, 5, and 6 is generally sufficient to keep the panels 10 aligned in the longitudinal direction (i.e., the direction of the joists 4, 5 and 6).

The male connectors 35 or 55 are preferably integrally formed, by injection molding, with the structural platform 30. The male connectors 35 or 55 may alternatively be formed by pultrusion or mounted, via riveting or other means, onto the structural platform 30. It will be observed that the male connectors 35 or 55 are disposed adjacent the female recesses 51, and the female receptacles 36 or 56 are disposed adjacent the male members 52.

The design of the platform panels or modules 10 facilitates rapid installation on a joint substructure 1. Moreover, the platform panels or modules 10 are configured as a single, identically configured stock-keeping-unit ("SKU") adequate to cover the entire joist substructure 1.

To appreciate the panel's or module's many advantages, it is insightful to understand the configuration of a typical joist substructure 1. A typical joist substructure 1 can be characterized as comprising a beginning-of-sequence side rim joist 4, a plurality of parallel in-line span joists 6, and an end-of-sequence side rim joist 5. Many prior art modular panel designs fail to fully cover the joist substructure 1, including the beginning-of-sequence side rim joist 4, the middle or in-line span joists 6, and the end-of-sequence side rim joist 6 so that the panels are flush with the outside edges of both the beginning and end-of-sequence side rim joists 4 and 5.

In a typical joist substructure 1 (FIG. 36), the in-line span joists 6 are equally spaced, typically 406 mm (16 inches) on center. To prepare a joist substructure 1 for complete coverage by the platform panels or modules 10, 66-68, 80, or 86 of FIGS. 1-53, the end-of-sequence side rim joist 5 is preferably spaced slightly closer (i.e., approximately the width of the joist closer) to the nearest in-line joist 6 (i.e., approximately 368 mm or 14.5 inches, center-to-center) than the in-line joists 6 are spaced from each other. (As described further below, the joist substructure 1 is prepared slightly differently for the embodiment shown in FIGS. 54-82). When installed, the platform panels or modules 10 interlock with each other and mount over the joist substructure 1 so that the decorative top layers 40, collectively, of the platform panels or modules 10 fully cover, and are flush with the outside edges of the entire joist substructure 1.

Figure 39:
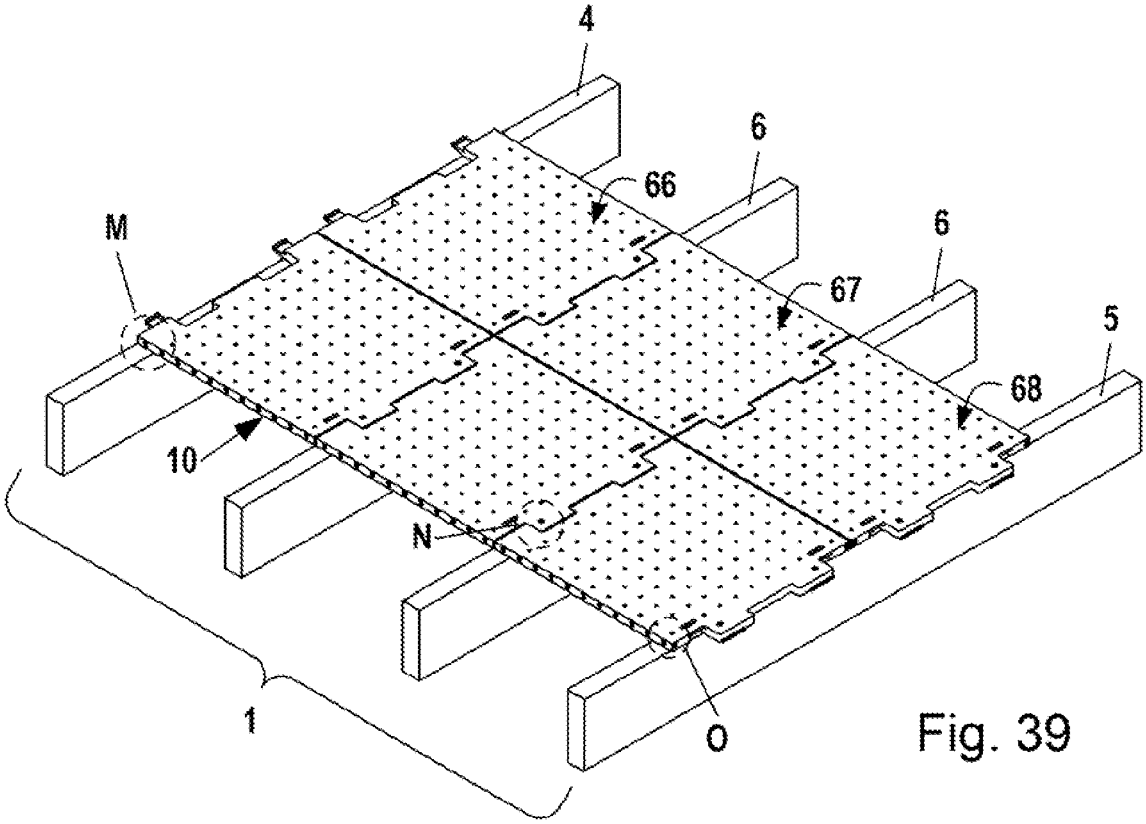
FIG. 39 is a top perspective view of six surface platform panels or modules, without any decorative veneers, installed on a joist substructure.
Figure 40:
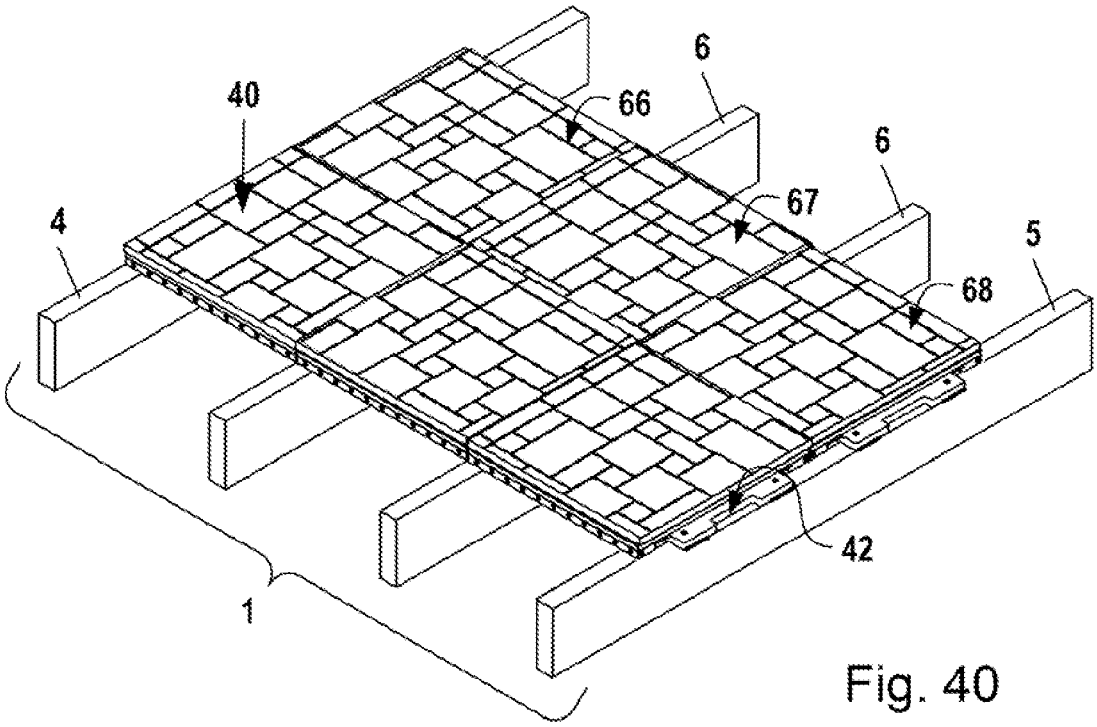
FIG. 40 is a top perspective view of the platform panels or modules of FIG. 38, with decorative veneers, installed on a joist substructure.

FIG. 39 illustrates six platform panels or modules 10, without decorative veneers 40, installed on another joist substructure 1. The joint substructure 1 includes a beginning-of-sequence side rim joist 4, two in-line span joists 6, and an end-of-sequence side rim joist 5. FIG. 40 illustrates six platform panels or modules 10, with decorative veneers, installed on the same joist substructure 1.

To construct the modular surface of FIG. 39 or 40, a first, or beginning-of-sequence platform panel or module 66 is installed on the beginning-of-sequence side rim joist 4 and the nearest in-line joist 6. Next, the first platform panel or module 66 is secured with threaded fasteners through the diagonal holes or indentations 44 on its panel coupling side 13 and through the vertical mounting holes 34 on panel coupling side 14 to the joists 4 and 6. Next, a second or "in-line" platform panel or module 67 is placed adjacent the first platform panel or module 66, in a tilted orientation, to position its male connectors 35 underneath the female receptacles 36 of the first platform panel or module 66. Then, the platform panel or module 67 is dropped into a level position, causing it to positively engage the first platform panel or module 66. Next, the second platform panel or module 67 is secured with threaded fasteners through the vertical mounting holes 34 on panel- or module-coupling side 14 to the second in-line joist 6. There is no need to use threaded fasteners to secure panel- or module-coupling side 13 to the first in-line joist 6, because that side 13 is already secured by being interlocked with the first platform panel or module 66.

After the first and second platform panels or modules 66 and 67 are installed, a third, end-of-sequence platform panel or module 68 is placed adjacent to and interlocked with the second platform panel or module 67, in much the same fashion as the second platform panel or module 67 was joined to the first platform panel or module 66. Because the end-of-sequence side rim joist 5 is spaced closer to its nearest in-line joist 6 than the normal between-joist spacing, the exposed platform section 42, which has a width of about 38 mm (1½ inches), overhangs the end-of-sequence side rim joist 5.

Figure 9:
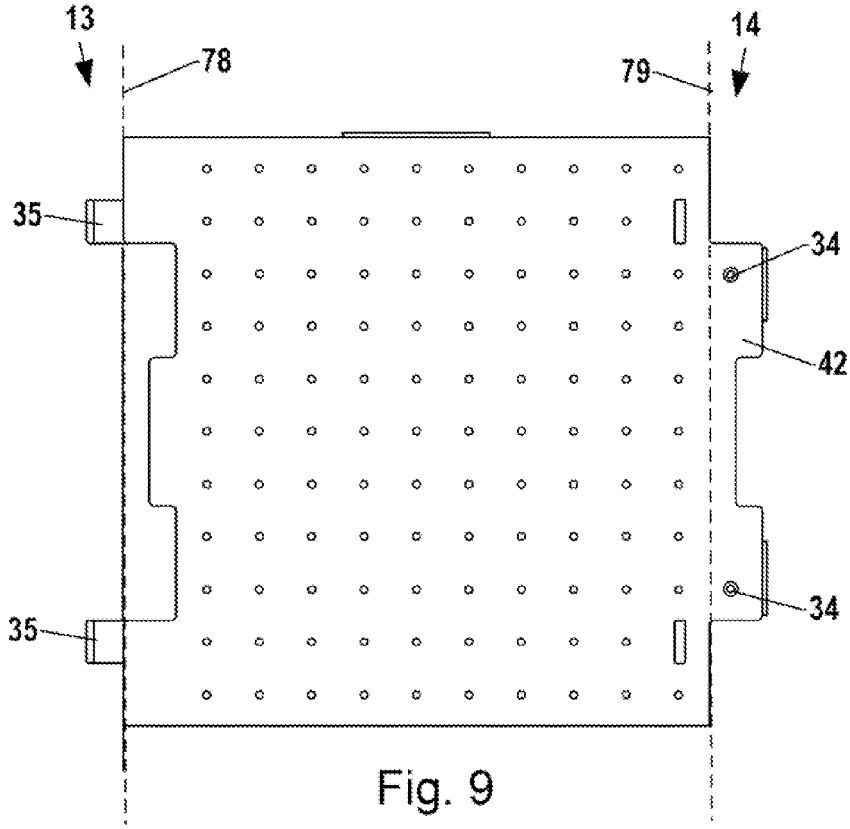
FIG. 9 is a top plan view of the platform panel or module of FIG. 8, with dashed lines showing cut lines for end-of-joist installations.

It is expected and intended that in common installations, the exposed platform section 42 of an end-of-sequence platform panel or module 68 will be cut off. Likewise, it is expected and intended that the exposed and unused male connectors 35 of a beginning-of-sequence platform panel or module 66 will be cut off. FIG. 9 illustrates appropriate and intended cut lines 78 and 79 along panel- or module-coupling sides 13 and 14

Figure 10:
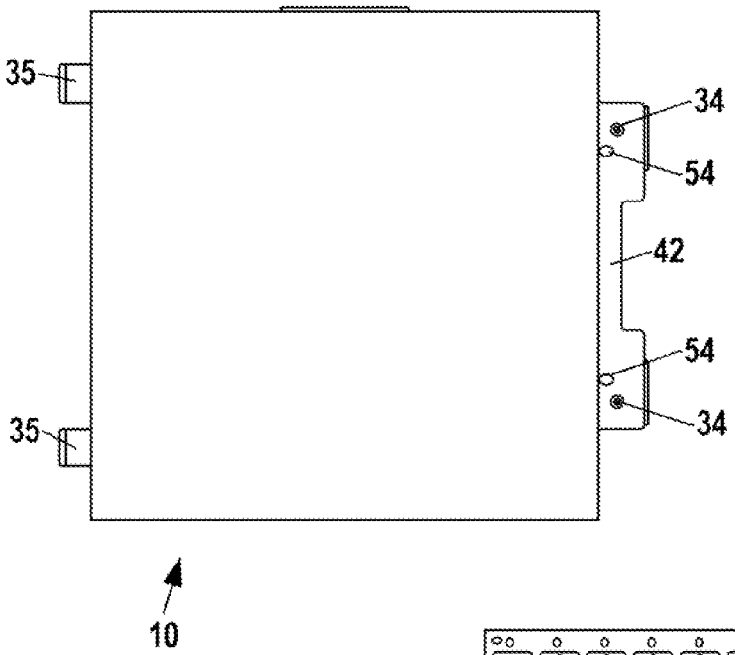
FIG. 10 is a top plan view of an alternative embodiment of a platform panel or module.
Figure 11:
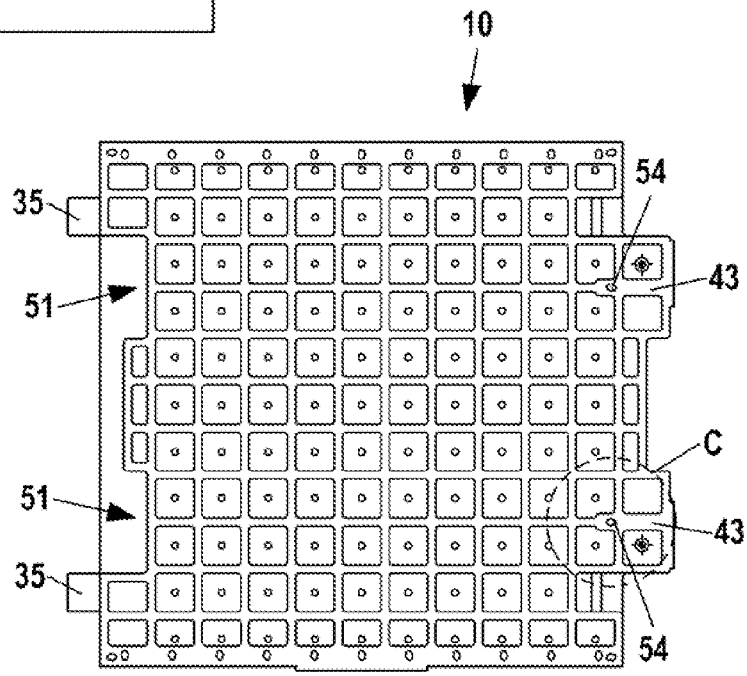
FIG. 11 is a bottom view of the platform panel or module of FIG. 10.
Figure 12:
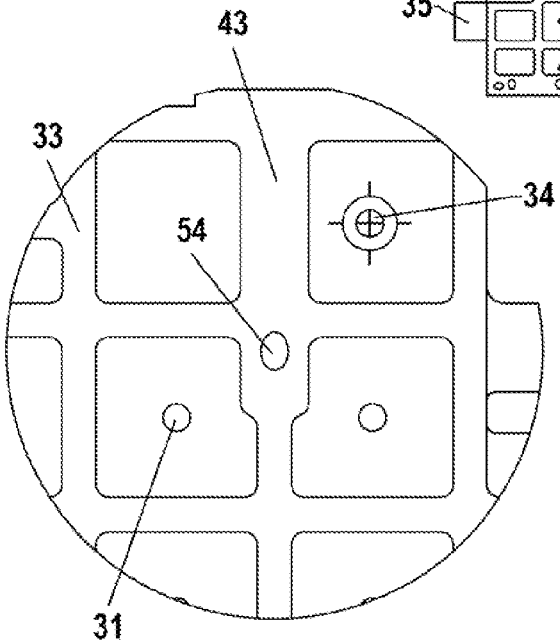
FIG. 12 is an enlarged view of the section designated "C" in FIG. 11.

To facilitate the installation of a platform panel or module 10 at the end of a sequence, after its exposed platform section 42 has been cut off, in one embodiment the platform panels or modules 10 come with a thickened rib portion 43, as illustrated in FIGS. 10-12. Two additional diagonal mounting holes 54, each with a 45-degree bevel, extend from the underside 32 of the platform panel or module 10 through the thickened rib portion 43 and through the upper side of the exposed platform section 42. Alternatively, only part-way centering dimples (not shown) are provided that extend part-way to the underside 32 of the platform panel or module 10. In this alternative, the centering dimples become complete through-holes when the exposed platform section 42 is cut off. In either case, the holes 54 or centering dimples are preferably pre-molded, pre-drilled, or otherwise pre-made with the platform panel or module 10.

Figure 37:
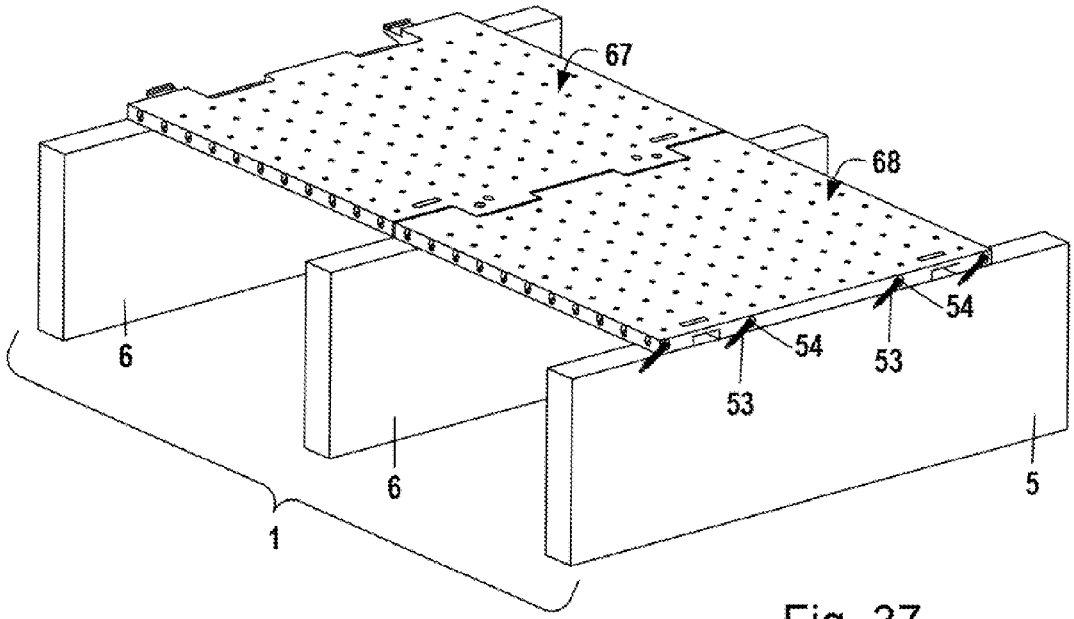
FIG. 37 is a perspective view of two interlocked platform panels or modules with removed end tabs installed on a joist substructure.
Figure 38:
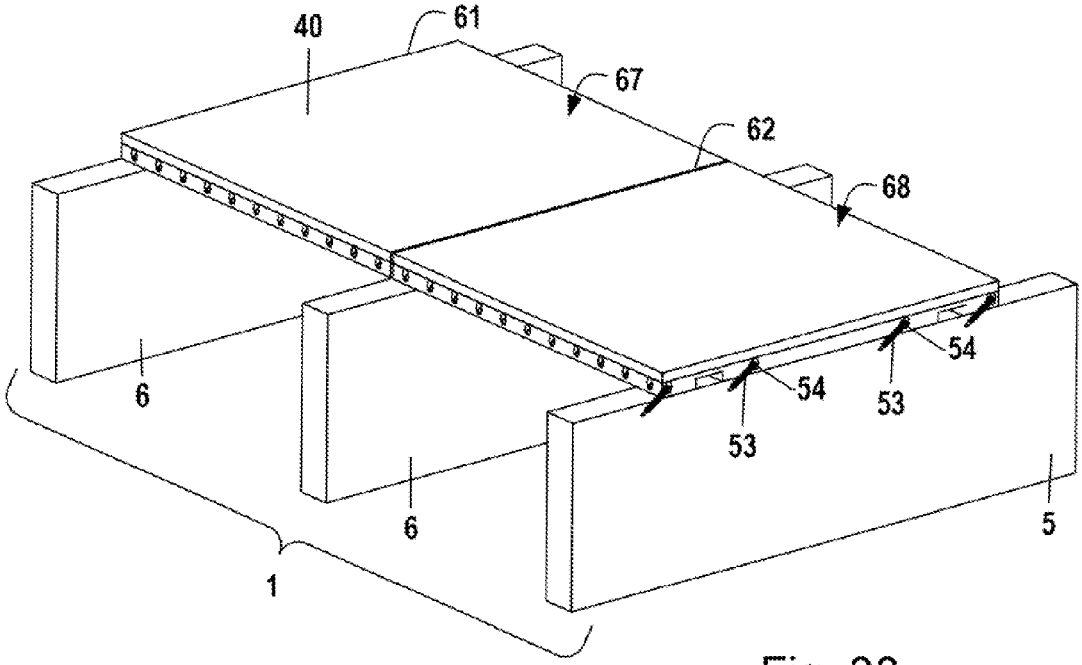
FIG. 38 is a perspective view of two interlocked platform panels or modules with decorative veneers and removed end tabs installed on a joist substructure.

FIGS. 37-38 illustrate end-of-sequence platform panels or modules 68 with their exposed platform sections 42 cut off. Threaded fasteners 53 have been inserted through the additional diagonal mounting holes 54 to mount the now-modified end-of-sequence platform panel or module 68 to the end-of-sequence side rim joist 5.

It will be understood that in the preferred embodiment, the beginning-of-sequence platform panel or module 66, the end-of-sequence platform panel or module 68, and all of the in-line platform panels or modules 67 will preferably have identical original configurations. However, alternative embodiments with differently configured platform panels or modules for beginning-of-sequence and end-of-sequence installations are still within the scope of the invention.

As illustrated in FIG. 38, each decorative top layer, surface or veneer element 40 has first and second parallel sides edges 61 and 62 that, in a standard configuration, are approximately 406 mm (16 inches) apart. When installed on the "in-line" span joists 6 of a joist substructure 1, the first parallel side edge 61 aligns flush with an outer edge of one of the in-line span joists 6, and the second parallel side edge 62 aligns with an inside edge of another one of the in-line span joists 6. (In the embodiment shown in FIGS. 54-82, by contrast, below, the decorative top layer, surface or veneer element 40 is centered on the substructure 30 and the parallel side edges 61 and 62 line up approximately along center midlines of the in-line span joists 6).

As illustrated in FIGS. 17-20, each platform panel or module 10 also includes two integrally-formed spacing ribs 37 and 38 protruding outwardly, approximately 3.2 mm (⅛ of an inch), from the distal edges of tabs 24 and 25. Each platform panel or module 10 also includes a spacing rib 39 protruding outwardly, approximately 3.2 mm (⅛ of an inch) from joist-spanning side 11. The ribs 37, 38, and 39 establish an exact, consistently-spaced gap between adjacent platform panels or modules 10, allowing for water drainage and air circulation.

Figure 14:
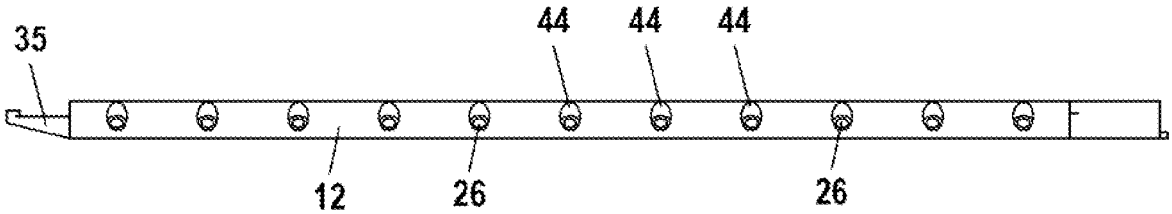
FIG. 14 is a side view of the platform panel or module of FIG. 4.
Figure 19:
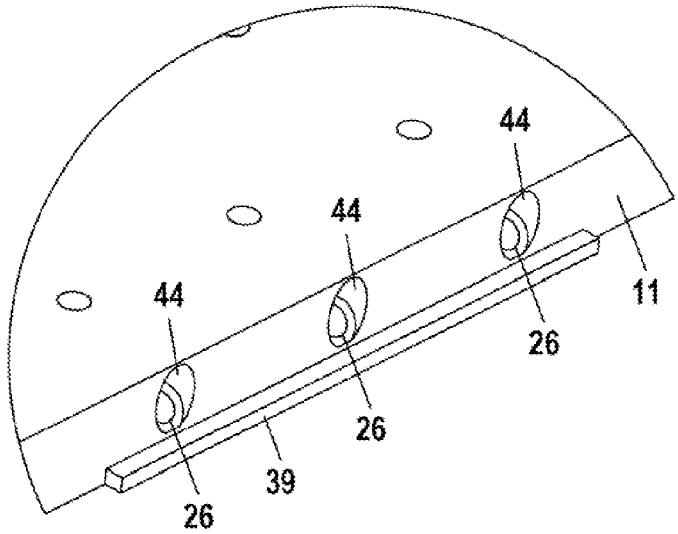
FIG. 19 is an enlarged view of the section designated "E" in FIG. 17.
Figure 20:
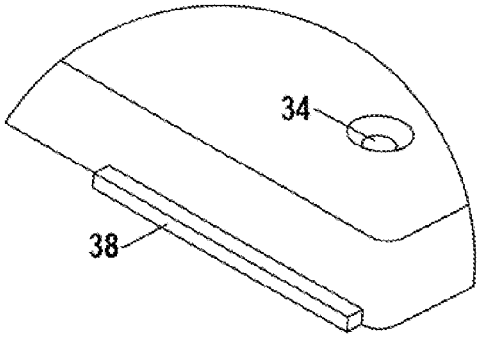
FIG. 20 is an enlarged view of the section designated "F" in FIG. 17.
Figure 21:
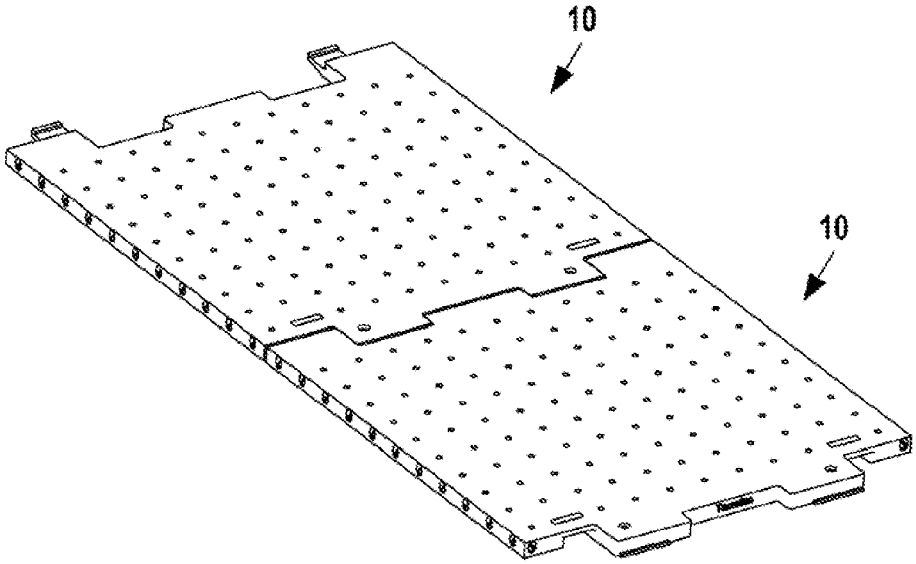
FIG. 21 is a top perspective view of an interlocking pair of FIG. 4's platform panels or modules.
Figure 22:
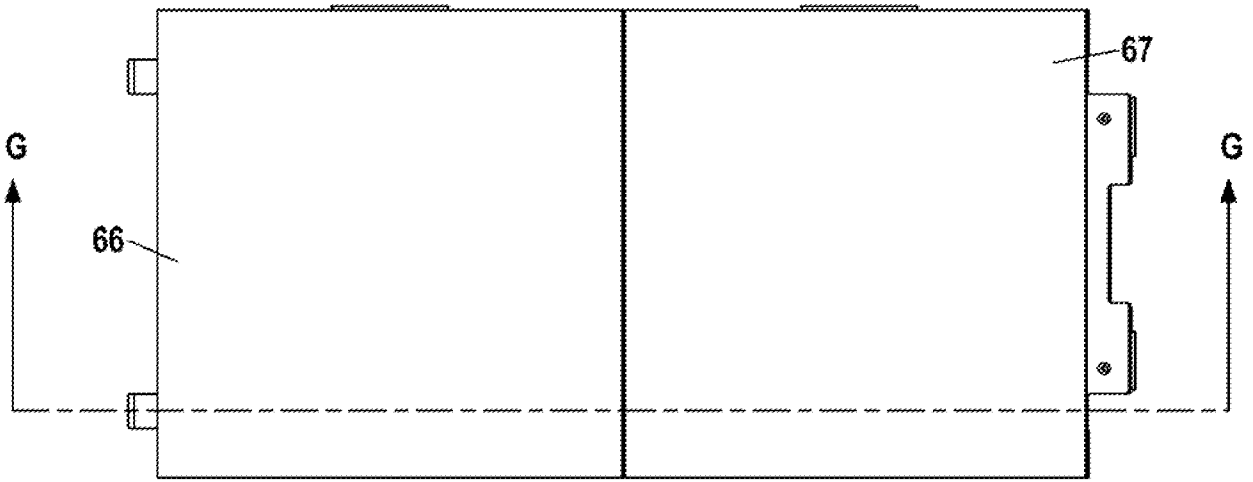
FIG. 22 is a top plan view of an interlocking pair of platform panels or modules.

As best illustrated in FIGS. 14 and 19, the linear joist-spanning sides 11 and 12 of each platform panel or module 10 include a plurality of regularly-spaced diagonal mounting pockets 44 to provide additional fastening capability. Like the pockets 44 illustrated in FIGS. 6, 41, and 43, these pockets 44 include a through-hole or pilot hole 26 that extends from one of the sides 11, 12, 13 or 14 of the structural platform 30 through to the underside 32 of the structural platform 30. Alternatively, equivalent pockets 64 are provided—as illustrated in FIGS. 54 and 62-65—that include a centering dimple or indentation 27 for guiding a fastener or drill. The pockets 44 facilitate even more secure mounting of the platform panels or modules 10 to a joist substructure.

Figure 44:
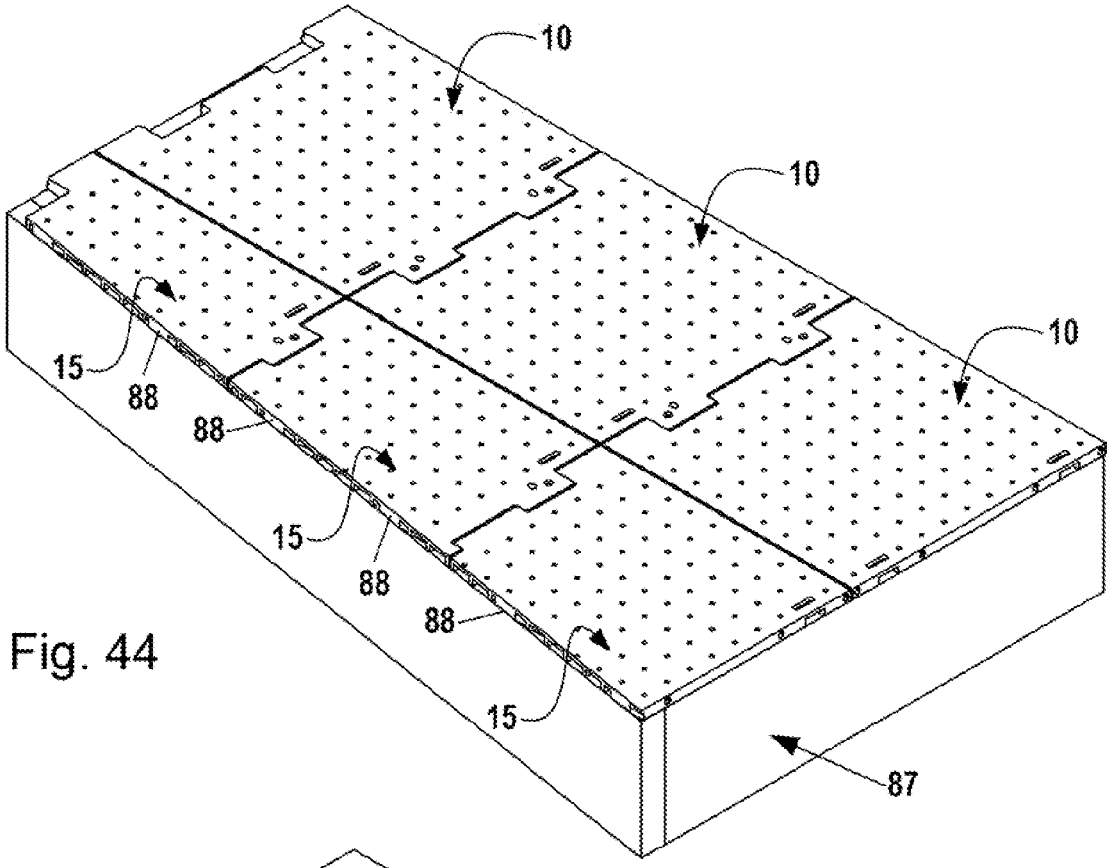
FIG. 44 is a top perspective view of a set of interlocking platform panels or modules trimmed to fit a trapezoidal deck substructure.
Figure 45:
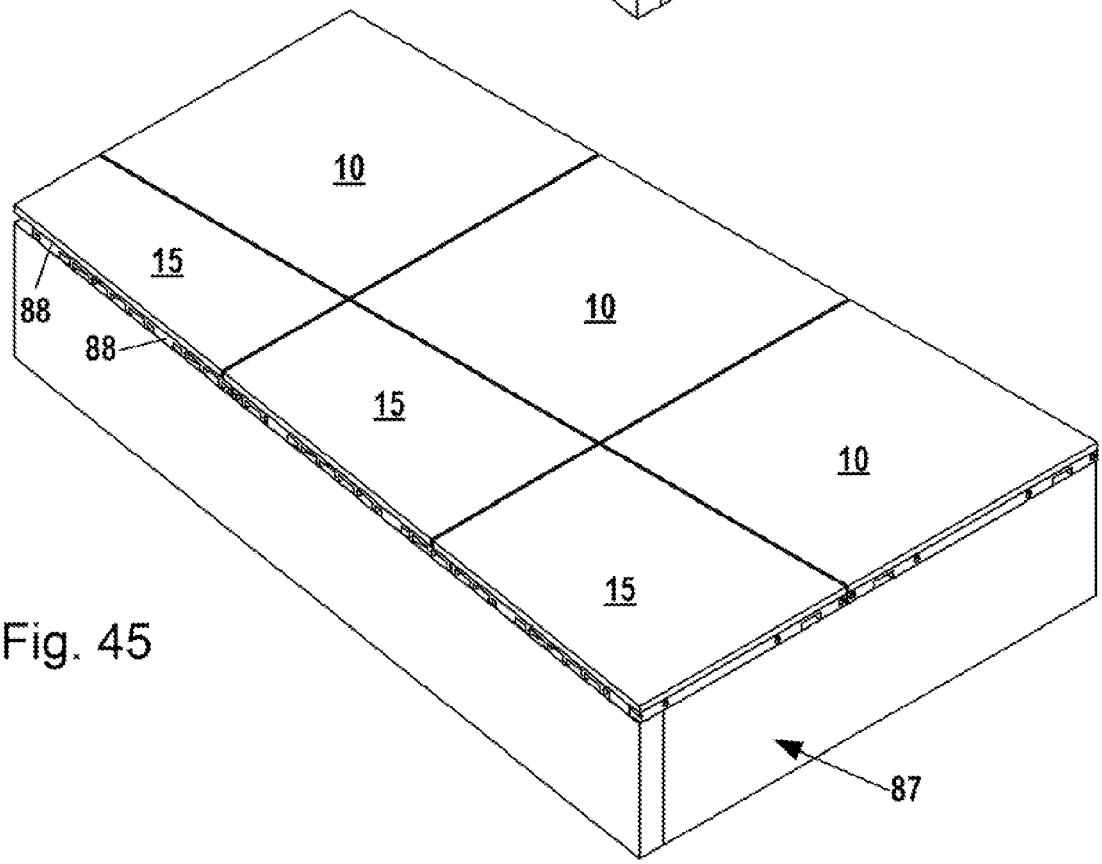
FIG. 45 is a top perspective view of a set of interlocking platform panels or modules, with decorative veneers, trimmed to fit a trapezoidal deck substructure.

The platform panels or modules 10 can also be trimmed into virtually any shape and still attached to a joist or pedestal substructure. FIGS. 44 and 45 illustrate groups of trimmed platform panels or modules 15, without or with decorative top layers 40, installed on trapezoidal joist substructures 87. Even when panels 15 have been trimmed in this fashion, they still retain a sufficient number of snap-together and screw-type fastening features to be securely mounted to the joist substructure 87. The angular cut to the platform panels or modules 15 may also reveal rib segments 88 through which field holes can be drilled and additional fasteners used to secure the trimmed platform panels or modules 15 to the joist substructure 87.

Figure 46:
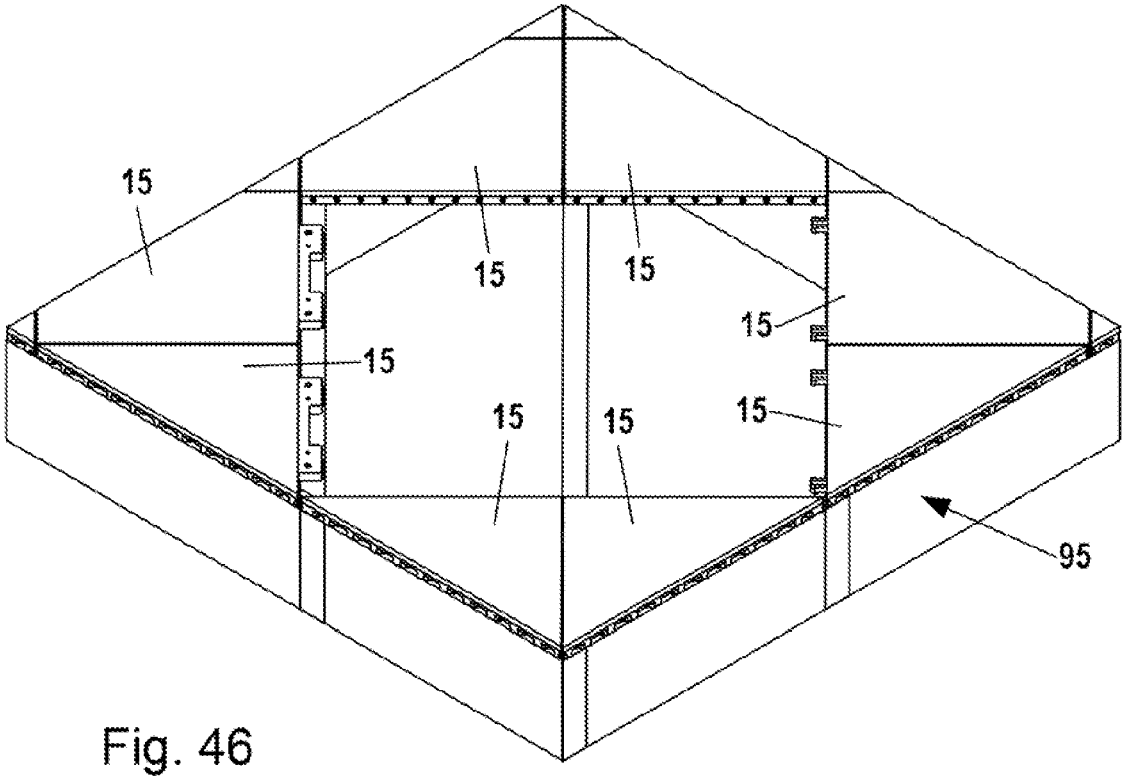
FIG. 46 is a top perspective view of a diagonal layout of several trimmed platform panels over a joist substructure.
Figure 47:
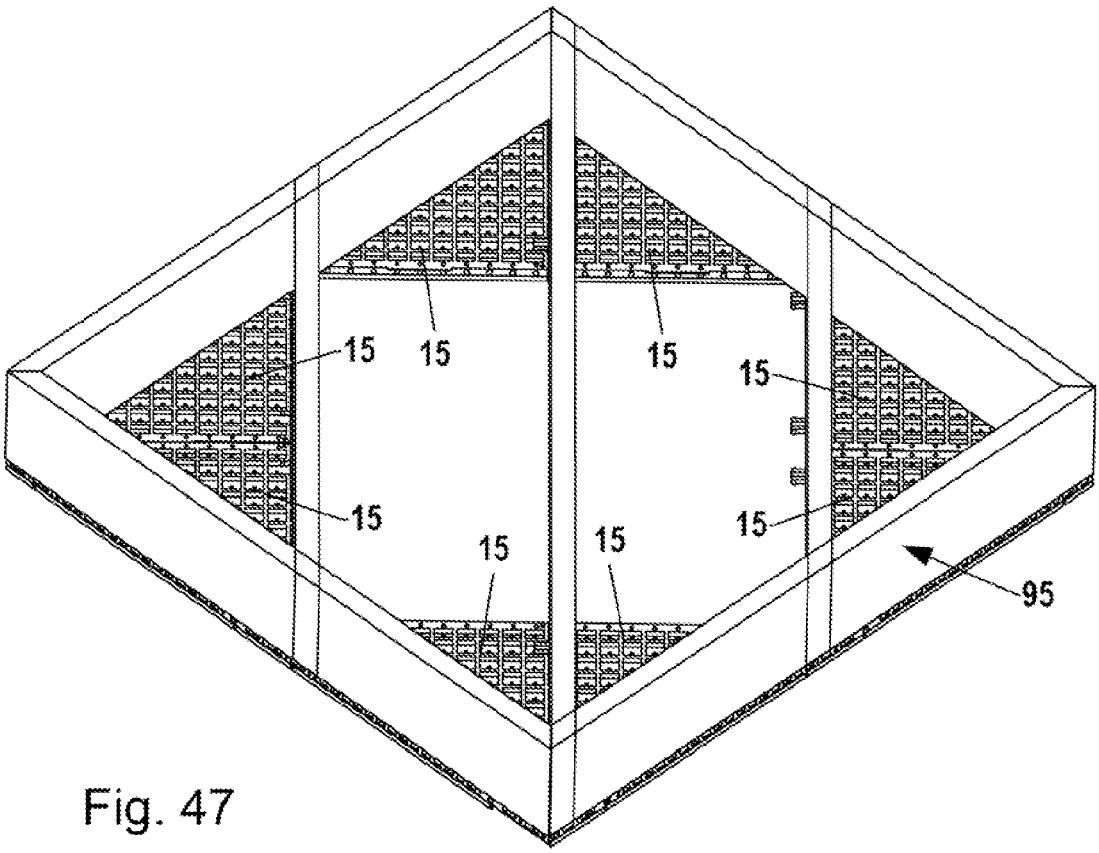
FIG. 47 is a bottom perspective view of the layout of FIG. 46.
Figure 48:
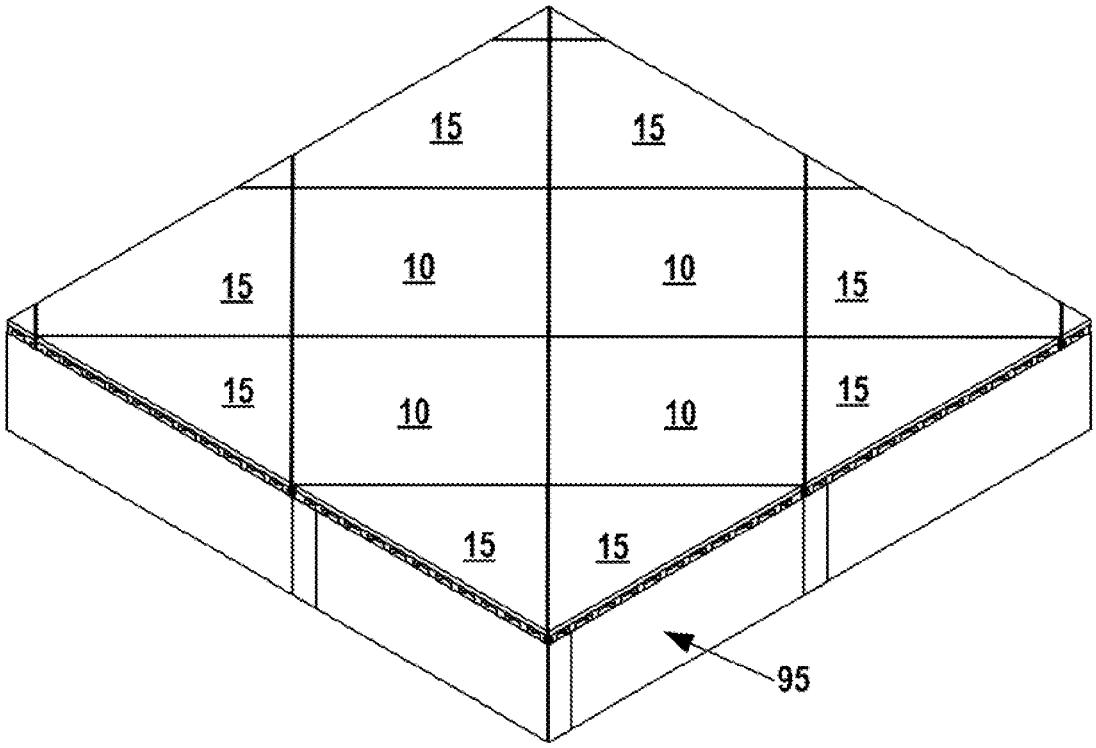
FIG. 48 is a top perspective view of a complete diagonal layout of both trimmed and untrimmed platform panels or modules over a joist substructure.

FIG. 46 illustrates a plurality of trimmed platform panels or modules 15, together with their top decorative layers 40, that have been installed on a diagonal joist substructure 95. FIG. 47 is a bottom perspective view of the structure of FIG. 46. FIG. 48 illustrates a combination of untrimmed platform panels or modules 10 and trimmed platform panels or modules 15 installed in a diamond pattern on the diagonal joist substructure 95.

Figure 49:
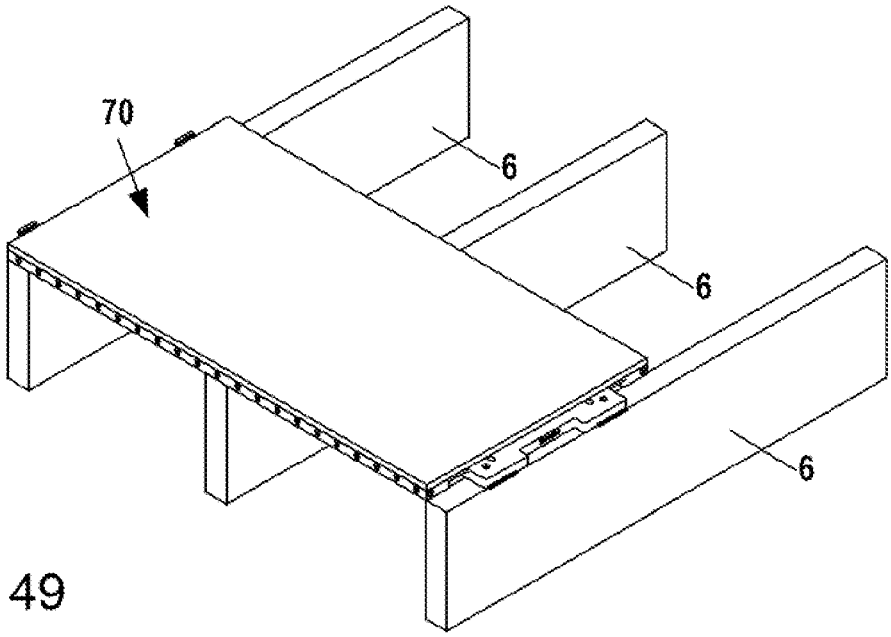
FIG. 49 is a perspective view of a rectangular modular platform panel or module.

FIG. 49 illustrates an extended rectangular-shaped modular surface platform panel 70 configured to span two in-line span joists 6. Other shapes and sizes of platform panels and modules are also within the scope of the present invention.

The platform panels or modules 10 are preferably packaged and sold with the decorative top layer 40 already attached, but they may be sold separately from the decorative top layer 40.

Figure 50:
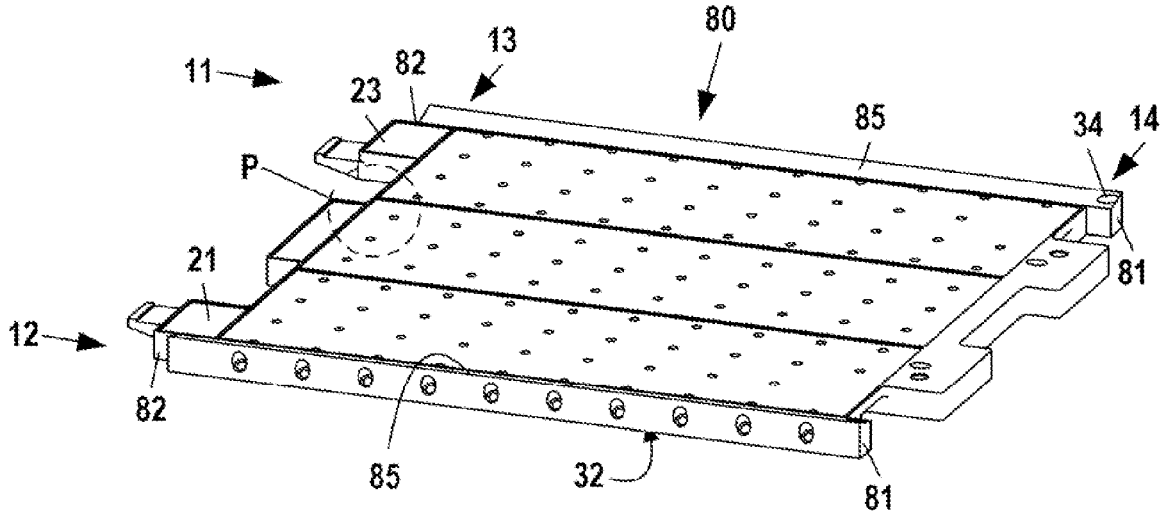
FIG. 50 is a perspective view of yet another embodiment of a platform panel or module.

FIG. 50 illustrates an embodiment of an improved platform panel or module 80. The improved platform panel or module 80 includes two new corner tabs or extensions 81, flush with the joist spanning sides 11 and 12 of extending outwardly from panel coupling side 14, and two corresponding indented portions 82 on the outsides of tabs 21 and 22 of the opposing panel coupling side 13. The corner tabs 81 include large fastener guides or vertical mounting holes or pockets 34 to further secure the platform panel or module 80. The corner tabs 81 allow all corners of the platform panel or module 80 to rest on the joists of an underlying substructure, helping to stabilize and minimize deflection of the platform panel or module 80.

Figure 51:
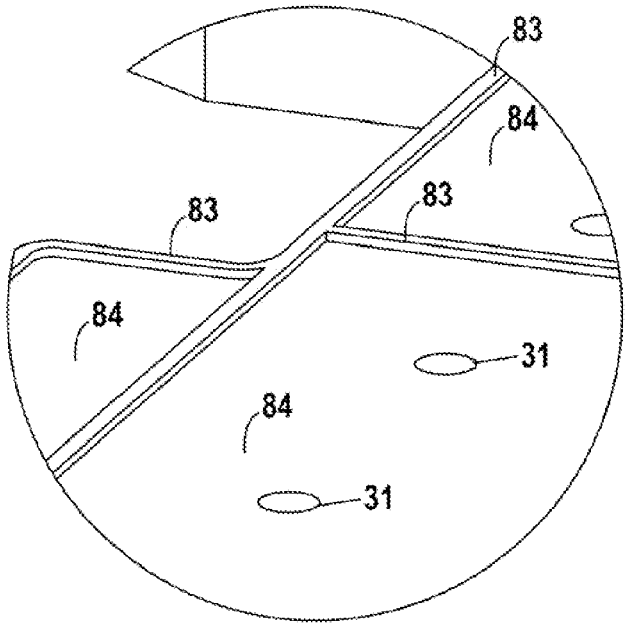
FIG. 51 is an enlarged view of the section designated "P" in FIG. 50

As better illustrated in FIG. 51, the improved platform panel or module 80 also includes a plurality of elongated, thin-walled glue spacers or standoffs 83. Each platform panel or module 80 includes one set of elongated spacers 83 that extend around the perimeter (or near the perimeter) of the platform panel or module 80. Each platform panel or module 80 also includes two spacers 83 that extend across the panel as two internal walls. The elongated glue spacers 83, each approximately 0.8 mm (1/32 inches) in height, define pockets 84 for glue to sit in before a decorative top layer or veneer element 40, such as a stone, is affixed to the platform panel or module 80. The elongated glue spacers 83 are a glue calibration feature that aids in the application of a uniform layer of glue to the platform panel or module 80. Also, as a decorative top layer or veneer element 40 is pressed against the platform panel or module 80, the elongated glue spacers 83 help to direct the compressed glue toward the orifices or apertures 31 and underside 32 of the platform panel or module 80.

Figure 52:
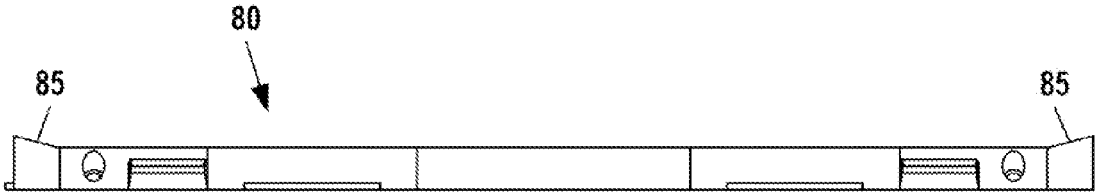
FIG. 52 is a side view of the platform panel or module of FIG. 50, with beveled edges to accommodate a beveled stone.

As better illustrated in FIG. 52, the improved platform panel or module 80 also includes beveled or sloped side shelves 85 along the joist spanning sides 11 and 12. The beveled or sloped side shelves 85 help hold a notched or beveled stone or other decorative top layer 40 in place.

Figure 53:
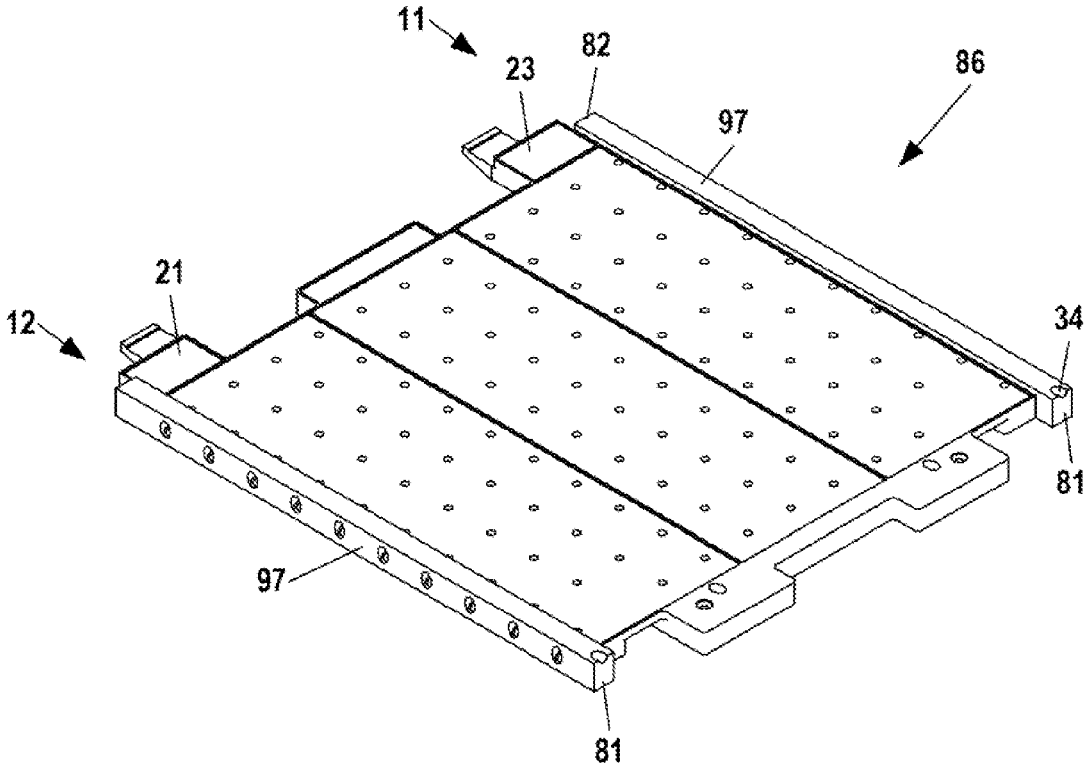
FIG. 53 is a perspective view of yet another embodiment of a prefabricated interlocking platform module.
Figure 54:
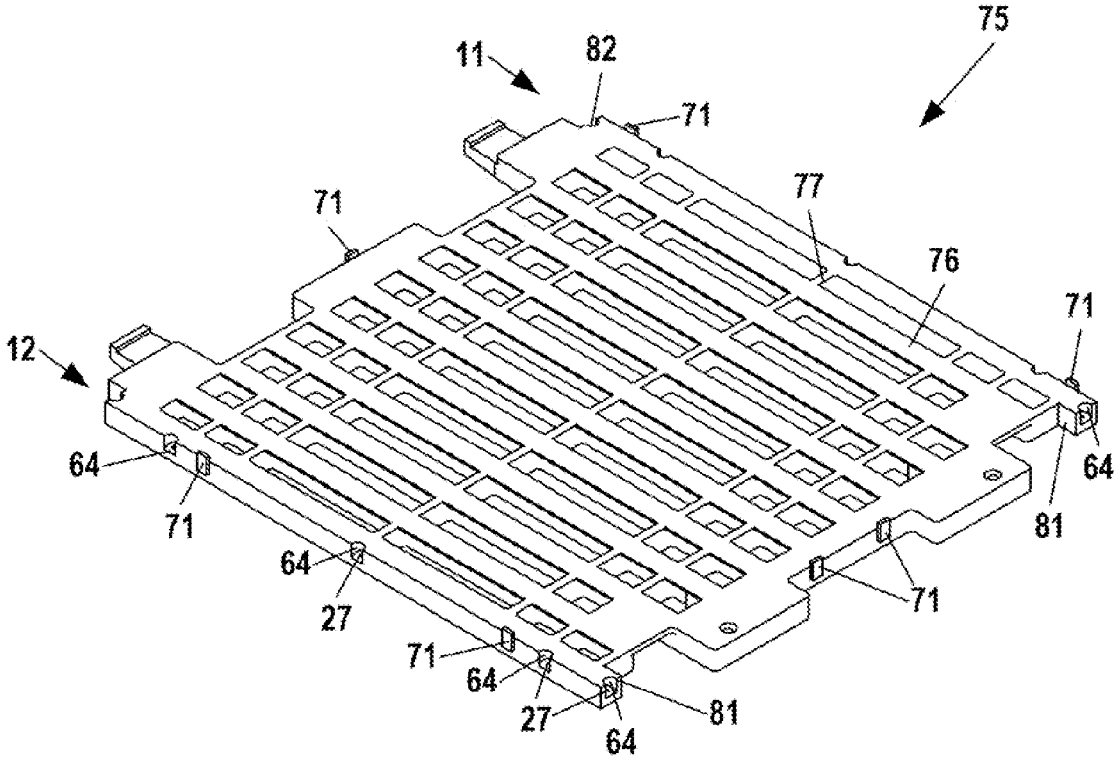
FIG. 54 is a perspective top view of a lighter-weight embodiment of a prefabricated interlocking platform module.
Figure 55:
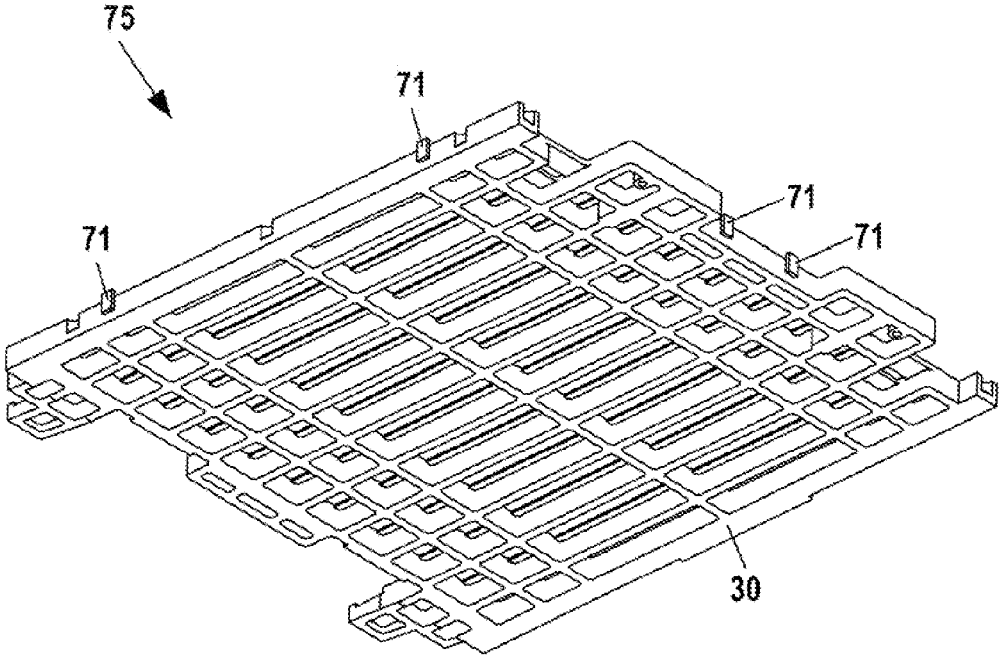
FIG. 55 is a perspective bottom view of the platform module of FIG. 54.

FIG. 53 illustrates another embodiment of a platform panel or module 86 much like the platform panel or module 80 of FIGS. 50-52, except that stepped side shelves 97, with rectangular cross-sections, are used in place of the beveled or sloped side shelves 85.

FIGS. 54-72 and 74-82 illustrate another embodiment of an interlocking platform module 75 with several improvements. The platform module 75 has a lattice or grid structure comprising a plurality of longitudinal ribs 76 that intersect with lateral ribs 77. Advantageously, the lattice or grid structure—by eliminating the substantially continuous, substantially planar top surface 20 depicted in prior embodiments—reduces the weight of the platform module 75 without compromising its strength.

It may be noted that the substantially continuous, substantially planar top surface 20 shown in the preceding platform panel or module embodiments provided a larger surface area for applying the glue. Moreover, the substantially continuous surface area acted as a basin for retaining most of the applied glue, except for that penetrating the orifices or apertures 31.

While the platform module 75 of FIGS. 54-72 and 74-82 does not provide a similar "basin" for the glue, the longitudinal ribs 76 have a T-shaped cross section to allow for a wider gluing surface. The T-shaped cross section is revealed in the bottom views of the platform module 75. Moreover, the top, horizontal portion of each longitudinal rib 76 is relatively thin. This facilitates a better mechanical connection with a top layer 40, as applied adhesive curl over the sides of and underneath the top horizontal portions of the longitudinal ribs 76.

Like the platform panel 80 embodiment depicted in FIG. 50, the platform module 75 of FIGS. 54-72 and 74-82 include corner tabs 81 that allow all corners of the platform module 75 to rest on the joists of an underlying substructure.

The platform module 75 also includes several upwardly extending top layer alignment tabs 71 along the joist-spanning sides 11 and 12 and the module-coupling sides 13 and 14. These alignment tabs 71 facilitate easy and proper alignment of the stone or other top layer 40 to the platform module 75, eliminating any need for a special fixture to facilitate alignment. In one embodiment, the alignment tabs have dimensions of approximately 3.2 mm vertical by 1.9 mm wide by 0.6 mm thick (0.125 inches vertical by 0.075 inches wide by 0.0225 inches thick). The alignment tabs also facilitate about 0.6 mm of spacing between interlocking platform modules 75.

Figure 79:
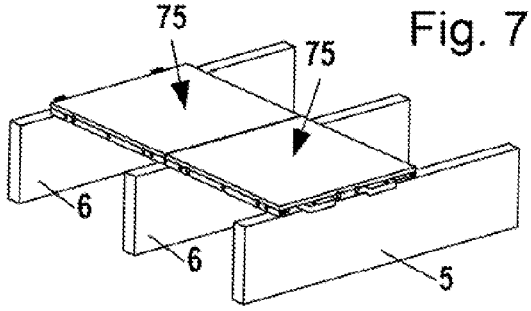
FIG. 79 is a perspective view of an interlocked pair of the platform modules of FIG. 54, including their decorative top layers, installed over a joist substructure.
Figure 80:
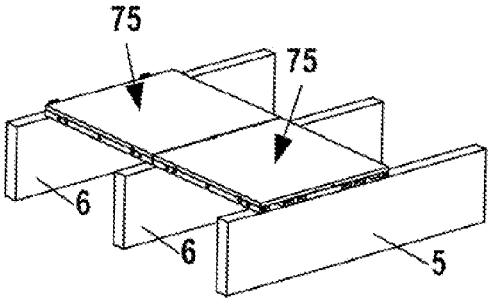
FIG. 80 is a perspective view showing the same interlocked pair of platform modules shown in FIG. 79, but with the end tabs cut off.
Figure 81:
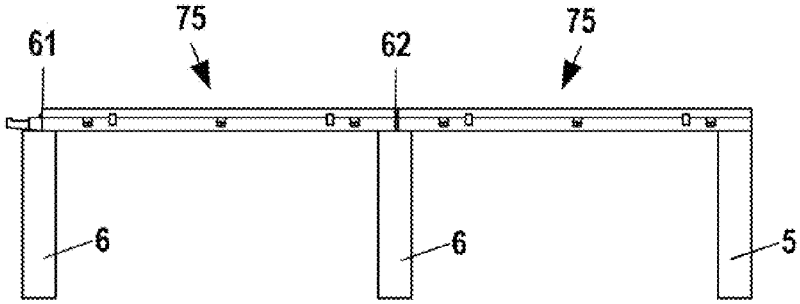
FIG. 81 is a side view of the interlocked pair of platform modules shown in FIG. 80.

In the embodiment of FIGS. 54-72 and 74-82, unlike what is shown in the preceding embodiments, the stone or other top layer 40 is centered on the platform module 75. When the platform module 75 is installed with a stone top layer 40, the side edges 61 and 62 of the stone line up with the center midlines of the in-line span joists 6, as illustrated in FIGS. 79-81. Therefore, to prepare a joist substructure 1 for complete coverage by the platform module 75, both the beginning-of-sequence side rim joist 4 and the end-of-sequence side rim joist 5 are preferably spaced slightly closer (i.e., approximately one-half of the width of the joist closer) to the nearest in-line joists 6 (or 387 mm center-to-center) than the in-line joists 6 are spaced from each other. Also, exposed sections 42 of both any beginning-of-sequence platform modules and any end-of-sequence platform modules would be cut off, but along the cut lines 78 and 79 illustrated in FIG. 82 (see, by contrast, the lines 78 and 79 illustrated in FIG. 9). Visual cut guide marks or a longitudinal notch may optionally be provided along lines 78 and 79 to facilitate the cut. In any event, the structural features of the platform module 75 can serve as guides for a saw to facilitate the making of these cuts. It will be understood that the preceding embodiments may also be modified to provide for a centered stone or other top layer 40.

In the embodiment of FIGS. 54-72 and 74-82, the multitude of diagonal pockets 44 shown in prior platform panel embodiments are substituted with up to three functionally equivalent diagonal mounting pockets 64 on each of the joist-spanning sides 11 and 12 and additional pockets 64 in each of the corner tabs 81 of the module-coupling side 14. Centering dimples, divots, or indentions 27 are molded into each of the recesses 64 facilitate drilling of holes and/or positioning of a fastener. Limiting the number of diagonal mounting pockets 64 increases the strength of the platform panel 75. It will be understood that the preceding embodiments may likewise be modified to provide for mounting pockets 64 that have centering dimples 27 rather than mounting pockets 44 that have through-holes or pilot holes 26.

It will be understood that the particular configurations of many of the new elements could be changed without departing from the spirit of the present invention. Many of the distinctive features or elements depicted in the various embodiments could be exchanged or combined into new embodiments. For example, the embodiment of FIGS. 54-72 and 74-82 may use the male connectors 55 with a pair of flexible, resilient arms 57 depicted in FIGS. 27-35 rather than the ones shown. Also, most of the platform panels or modules 10 and top decorative surface portions 40 in this specification are depicted with a generally square shape. More specifically, a standard embodiment of a platform panel or module 10 is depicted that is suitable for span joists 6 that are spaced approximately 406 mm (16 inches) apart. Typically, joist substructures are designed to with spans suitable for dividing a 1219 mm span (four foot) into a whole number of sections. Consequently, joist substructures with 305 mm (12 inch) and 610 mm (24 inch) center-to-center spacing between span joists 6 are also relatively common. The invention is intended to cover platform panels or modules 10 sized for these common types of joist substructures, as well as uncommon joist substructures. Moreover, as FIG. 49 illustrates, the invention is intended to cover platform panels or modules 10 sized to span multiple joists. Finally, unless the claims specifically exclude the following scope, the shape of either the platform panels or modules 10 or the top decorative surface portions 40 may be a variety of different sizes and shapes, including rectangular, triangular, polygonal, and any number of curved and/or non-linear profiles.

It is the inventors' intent that the scope of any of the claims be defined by the language of the claims, and not narrowed by reference to the embodiments described in this summary, the detailed description of the invention, or to any particular need, object, or suggested solution described in this specification.

It will be understood that the particular configurations of many of the new elements could be changed without departing from the spirit of the present invention. For example, most of the platform panels or modules 10 and top decorative surface portions 40 in this specification are depicted with a generally squarish shape. More specifically, a standard embodiment of a platform panel or module 10 is depicted that is suitable for span joists 6 that are spaced approximately 406 mm (sixteen inches) apart. Typically, joist substructures are designed to with spans suitable for dividing a 1219 mm (four foot) span into a whole number of sections. Consequently, joist substructures with 305 mm (12 inch) and 610 mm (24 inch) center-to-center spacing between span joists 6 are also relatively common. The invention is intended to cover platform panels or modules 10 sized for these common types of joist substructures, as well as uncommon joist substructures. Moreover, as FIG. 49 illustrates, the invention is intended to cover platform panels or modules 10 sized to span multiple joists. Finally, unless the claims specifically exclude the following scope, the shape of either the platform panels or modules 10 or the top decorative surface portions 40 may be a variety of different sizes and shapes, including rectangular, triangular, polygonal, and any number of curved and/or non-linear profiles.

Having thus described exemplary embodiments of the present invention, it should be noted that the disclosures contained in FIGS. 1-82 are exemplary only, and that various other alternatives, adaptations, and modifications may be made within the scope of the present invention. Accordingly, the present invention is not limited to the specific embodiments illustrated herein, but is limited only by the following claims.

We claim:

1. A modular surface platform panel for a deck, floor, wall, ceiling, or roof, the modular surface platform panel comprising:
- a decorative top layer;
- a structural platform that supports at least most of the decorative top layer;
- the structural platform having two opposite joist-spanning sides and opposite first and second joist-subframe connecting sides, wherein:
  - the first joist-subframe connecting side includes snap-fit receptacles near opposite ends of the first joist-subframe connecting side;
  - the first joist-subframe connecting side further includes, in between the snap-fit receptacles, one or more members, integral with the structural platform, that protrude beyond the decorative top layer;
  - one or more fastener guides are provided in the one or more protruding members for fastening the panel to a joist of a supporting joist subframe;
  - the second joist-subframe connecting side includes snap fit connectors near opposite ends of the second joist-subframe connecting side, the snap fit connectors being configured to interlock the platform panel with the snap-fit receptacles of the first joist-subframe connecting side of a like platform panel; and
  - in between the snap fit connectors, the second joist-subframe connecting side includes one or more complementary recesses that are configured to receive, and conceal underneath the decorative top layer, the one or more protruding members of the first joist-subframe connecting side of the like platform panel.

2. The modular surface platform panel of claim 1, wherein the snap-fit connectors are received into the snap-fit receptacles of an adjoining like panel by movement of the snap-fit connectors along a vertical dimension, perpendicular to the decorative top layer.

3. The modular surface platform panel of claim 2, wherein the modular surface platform panel is adapted to be installed in interlocking relation with an adjoining platform panel by tilting the panel to position the snap-fit connectors underneath the snap-fit receptacles and then dropping the panel into a position, coplanar with the adjoining platform panel, in a manner that interlocks the snap-fit connectors with the snap-fit receptacles.

4. The modular surface platform panel of claim 1, wherein the panel-to-panel interlocking mechanism is further characterized in that:
- the snap-fit connectors comprise a pair of flexible, resilient arms; and
- the modular surface platform panel is adapted to be installed in interlocking relation with an adjoining platform panel by pushing the modular surface platform panel into interlocking relation with the adjoining platform panel so that the flexible, resilient arms of the modular surface platform panel flex inward and snap back outward into engagement with the snap-fit receptacles of the adjoining platform panel.

5. The modular surface platform panel of claim 1, wherein the decorative top layer is approximately 12 inches, 16 inches, or 24 inches wide, and the structural platform is approximately 1.5 inches wider than the decorative top layer, whereby when the modular surface platform panel is installed to bridge two in-line joists of a supporting substructure, the joist-subframe connecting sides extend across the full width of the supporting substructure.

6. The modular surface panel of claim 1, wherein the opposite joist-spanning sides are substantially linear, in contrast to the joist-coupling sides, which have a relatively more crenellated profile.

7. The modular surface panel of claim 1, further comprising a plurality of spaced-apart diagonal mounting holes or pockets extending inwardly from one or more sides of the structural platform.

8. The modular surface platform panel of claim 1, wherein the platform panel comprises a lattice-like structure comprising a plurality of longitudinal ribs that intersect with lateral ribs not integrally formed with a substantially continuous, substantially planar top surface.

9. The modular surface platform panel of claim 1, wherein each platform panel comprises a substantially continuous, substantially planar top surface over and integral with a grid of reinforcing ribs.

10. The modular surface platform panel of claim 9, wherein a plurality of small apertures are provided in the substantially continuous, substantially planar top surface to receive glue or fasteners for securing the decorative top layer thereto.

11. The modular surface platform panel of claim 1, wherein:

the structural platform is an integral, single-piece unit of injection-molded, cured plastic resin.

12. The modular surface platform module of claim 1, wherein the decorative top layer has side edges that, when the structural platform is installed to bridge two supporting in-line span joists of a joist subframe, align approximately along midlines of the in-line span joists.

13. The modular surface platform panel of claim 1, a decorative top layer; and wherein the decorative top layer is secured to the structural platform via adhesive, some of which penetrates through apertures in the structural platform and mushrooms against a bottom side of the structural platform.

14. The modular surface platform panel of claim 13, wherein the structural platform is a single-piece injection-molded part.

15. The modular surface platform panel of claim 13, further comprising a plurality of spacers along a top side of the structural platform for facilitating a uniform application of glue to the top side.

16. The modular surface platform panel of claim 15, wherein the spacers define one or more pockets for guiding the glue, when compressed by the decorative top layer, through the apertures.

* * * * *